US010913142B2

(12) United States Patent
Takeda

(10) Patent No.: US 10,913,142 B2
(45) Date of Patent: Feb. 9, 2021

(54) ELECTRIC TOOL

(71) Applicant: Koki Holdings Co., Ltd., Tokyo (JP)

(72) Inventor: Yuuki Takeda, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 110 days.

(21) Appl. No.: 16/203,639

(22) Filed: Nov. 29, 2018

(65) Prior Publication Data

US 2019/0091849 A1 Mar. 28, 2019

Related U.S. Application Data

(63) Continuation of application No. 15/322,451, filed as application No. PCT/JP2015/067724 on Jun. 19, 2015, now Pat. No. 10,173,311.

(30) Foreign Application Priority Data

Jun. 30, 2014 (JP) ..... 2014-135465

(51) Int. Cl.

| | |
|---|---|
| ***B25F 5/00*** | (2006.01) |
| ***B24B 23/02*** | (2006.01) |
| ***B24B 49/10*** | (2006.01) |

(52) U.S. Cl.

CPC ..... *B25F 5/008* (2013.01); *B24B 23/02* (2013.01); *B24B 23/028* (2013.01); *B24B 49/10* (2013.01); *B25F 5/00* (2013.01)

(58) Field of Classification Search

CPC ..... B25F 5/008; B24B 23/02; B24B 23/028; B24B 49/10; H02K 15/002; H02K 7/14

USPC ..... 173/46; 328/174

See application file for complete search history.

(56) References Cited

U.S. PATENT DOCUMENTS

| | | | | |
|---|---|---|---|---|
| 4,385,276 | A * | 5/1983 | Bitzel | G01P 3/487 310/47 |
| 6,798,079 | B2 * | 9/2004 | Nelson | F01D 25/12 290/2 |
| 2009/0200878 | A1 * | 8/2009 | Walter | H02K 5/18 310/50 |
| 2009/0218113 | A1 * | 9/2009 | Johnen | B03C 1/0332 173/20 |
| 2011/0248583 | A1 * | 10/2011 | O'Banion | H02K 5/18 310/50 |
| 2015/0097641 | A1 * | 4/2015 | Chen | B25F 5/02 335/126 |

* cited by examiner

*Primary Examiner* — Nathaniel C Chukwurah
(74) *Attorney, Agent, or Firm* — JCIPRNET

(57) ABSTRACT

The electric tool including a motor having a stator and a rotor, a rotation shaft integrally rotating with the rotor, a casing accommodating the motor, a ventilating window disposed in the casing, a cooling fan sucking an air through the ventilating window to cool off the motor, a magnetic body disposed to the rotation shaft, a magnetic detection unit detecting a rotational position of the magnetic body, and a circuit substrate on which the magnetic detection unit is mounted. The circuit substrate and the magnetic body are disposed to be isolated from a wind path of a cooling wind generated by rotation of the cooling fan.

20 Claims, 10 Drawing Sheets

ELECTRIC TOOL

CROSS-REFERENCE TO RELATED APPLICATION

This application is a continuation application of and claims the priority benefit of U.S. application Ser. No. 15/322,451, filed on Dec. 28, 2016, now allowed (U.S. Pat. No. 10,173,311 B2). The prior application Ser. No. 15/322,451 is a 371 application of the international PCT application serial No. PCT/JP2015/067724, filed on Jun. 19, 2015, which claims the priority benefit of Japan application No. 2014-135465, filed on Jun. 30, 2014. The entirety of each of the above-mentioned patent applications is hereby incorporated by reference herein and made a part of this specification.

BACKGROUND OF THE DISCLOSURE

Field of the Disclosure

The disclosure relates to an electric tool using a brushless motor, and particularly provides an electric tool capable of suppressing permeation of moisture or dust into an internal space of a motor, a bearing part, or a control circuit substrate, thereby increasing a device lifetime.

Description of Related Art

Currently, electric tools using a brushless direct current (DC) motor and a controller, such as a microcomputer, to control rotation of a motor at a high precision are already known. The brushless DC motor uses a sensor magnet to detect a rotational position of a rotor, and uses the controller to control a driving current supplied to a coil of the motor, thereby controlling the rotation at a high precision. The technique of Patent Literature 1 is known as an electric tool using such brushless DC motor. Here, a conventional electric tool (a disc grinder here) is described with reference to FIG. 14. FIG. 14 is a longitudinal cross-sectional view illustrating a conventional electric tool 101. A frame body ("casing" in a general sense) of the electric tool 101 is formed by a motor casing 102 accommodating a motor 106 as a driving source, a rear cover 104, and a gear box 103. In the rear cover 104, a power cord 128 connected externally and a power switch 151 turning on and off power of the electric tool 101 are disposed. The gear box 103 accommodates a driving transmission unit. The driving transmission unit includes bevel gears 122 and 132 performing approximately 90° conversion on a power transmission direction of a rotation shaft of the motor, and accommodates a spindle 131 of an output shaft of a grindstone 29. On a periphery of a rear side of the grindstone 29, a protection cover 126 preventing spreading of dust caused by cutting is disposed.

Regarding the disc grinder, sometimes the disc grinder is being operated while being held single-handed. Therefore, a diameter of a gripping part 102*a* for the operator to hold needs to be thin and easy to grip. Under such circumstance, the motor casing 102 is integrally formed in a substantially cylindrical shape to ensure its strength. The motor 106 is inserted from a front side of the motor casing 102, and a stator (a stator core 108 wound with a coil 112) is disposed on an outer circumferential side of the motor 106, and a rotor (a rotor core 107 and a cylindrical magnet 109 disposed on an outer circumferential part of the rotor 107) is disposed on an inner circumferential side of the motor 106. On the front and rear sides of the motor 106, a rotation shaft is axially supported by ball-type bearings 118 and 117. In addition, on a front side of the rotation shaft 110, a cooling fan 120 configured to generate a cooling wind is disposed, and on a rear side of the rotation shaft 110, a sensor magnet 114 in a cylindrical shape is disposed to detect a rotational position of the rotor. In the rear cover 104, a control circuit substrate 165 configured to mount a controller 171 controlling the motor and a rectifier circuit 167 and an inverter circuit substrate 144 configured to mount a three-phase alternate current (AC) inverter circuit generating a magnetic field for generating rotation to the coil 112 of the motor 106 are disposed. Six switch elements 166 are mounted on the inverter circuit substrate 144, and three Hall ICs 141 are disposed at positions opposite to the sensor magnet 114.

PRIOR ART LITERATURE

Patent Literature

[Patent Literature 1] Japanese Patent Publication No. 2010-269409

SUMMARY OF THE DISCLOSURE

In the conventional technique shown in FIG. 14, in order to cool off a part that generates heat during operation, particularly the motor 106 and the switch elements 166, a wind path of the cooling wind generated by the cooling fan 120 is specifically designed. Thus, a configuration as follows is designed. Ventilating windows 148 and 149 are disposed on a periphery of the circuit substrate of the rear cover 104 to suck an external gas, and the cooling wind flows as indicated by arrow signs in FIG. 14. Accordingly, the gas is eventually discharged from a front side through a through hole 103*c* formed at the gear box 103. Here, the cooling wind flows along a periphery of the switch elements 166 in a preferable efficiency, and flows forward along an axial direction in a space between the stator core 108 and the rotor core 107 of the motor 106 (a space part at a proximity of a slot or a magnetic pole piece of the stator core 108), so as to cool off the motor 106. However, since a powerful permanent magnet is used in the rotor part, if iron powder enters the inside of the motor, the iron powder may be attached to the magnet without being discharged, thereby forming internal blockage. Besides, at a proximity of the sensor magnet 114 for position detection, the cooling wind may flow through in order to cool off the switch elements 166 nearby. However, if the iron powder is attached to the sensor magnet 114, the iron powder may remain attached, and a magnetic anomaly may occur, making it unable to control the rotation of the motor 106, which may possibly stop the motor 106.

The disclosure is provided in consideration of the background. The disclosure provides an electric tool with a configuration as follows: namely, the electric tool prevents anomalies in motor rotation due to dust and moisture sucked in together with cooling wind, and is configured such that rotational position detection operations and switch operations are not affected.

The disclosure further provides an electric tool capable of suppressing iron powder from being attached to the inside of the motor or the sensor magnet even if the iron powder is mixed into the casing.

Technical Means for Solving the Issue

The electric tool including a motor having a stator and a rotor, a rotation shaft integrally rotating with the rotor, a casing accommodating the motor, a ventilating window disposed in the casing, a cooling fan sucking an air through the ventilating window to cool off the motor, a magnetic body disposed to the rotation shaft, a magnetic detection unit detecting a rotational position of the magnetic body, and a circuit substrate on which the magnetic detection unit is mounted. The circuit substrate and the magnetic body are disposed to be isolated from a wind path of a cooling wind generated by rotation of the cooling fan.

According to other characteristics of the disclosure, the housing is formed of a non-magnetic material, and, as a divided configuration, sets a space to be a seal structure, or is in a shape of a container having an opening part and covered by a solidifiable water-resistant material, such as silicon, inside the housing, so as to configure a water-resistant and dust-resistant structure. Accordingly, splashing of water onto electronic elements mounted in the housing can be prevented. Besides, the controller and the magnetic detection unit are configured on the circuit substrate disposed in the housing as a water resistant and dust resistance structure together with other electronic elements. Therefore, an electric tool having a higher durability and reliability is provided. Moreover, since the housing is formed of synthetic resin or non-magnetic metal, the housing hardly has an influence on a magnetic field generated by a magnetic body. Therefore, the magnetic detection unit capable of being accommodated in the housing.

According to another characteristic of the disclosure, the casing is in a cylindrical shape, the ventilating window for sucking the external gas is disposed on a rear side in an axial direction, and a ventilating window for discharging air is disposed on a front side of the casing. The casing has a bearing holding part holding a bearing providing axial support to the rotation shaft of the motor, and the magnetic body and the bearing held in a state of being separated from the wind generated by the cooling fan by connecting the bearing holding part and the housing. Moreover, since a cover member is disposed between the bearing holding part and the stator to isolate the wind generated by the cooling fan and an internal space of the motor, the cooling wind is prevented from entering the inside of the motor, thereby eliminating damages to the motor caused by the iron powder or moisture entering the casing. Furthermore, since a wall surface of the housing is disposed between the magnetic body and the magnetic detection unit, dust resistance on the side of the magnetic body and dust resistance on the side of the magnetic detection unit are independent from each other.

Inventive Effect

According to the disclosure, the wind path of the cooling wind generated by rotation of the cooling fan is disposed to be isolated from the inside of the motor and the sensor magnet, so the cooling wind does not enter the inside of the motor and a space of the sensor magnet. Accordingly, dust mixed with iron powder entering externally may be prevented from attaching to a magnet part. Moreover, the magnetic detection unit detecting the magnetic field of the sensor magnet or the mounting substrate thereof is disposed to be isolated from the wind path of the cooling wind generated by rotation of the cooling fan. Therefore, moisture entering externally is prevented from being attached to the electronic element, and, as consequences, the lifetime of the electric tool is lengthened in addition to preventing malfunctions. The aforementioned and other purposes as well as novel features of the disclosure shall be understood based on descriptions of the specification as follows and the accompanying drawings.

DESCRIPTION OF THE EMBODIMENTS

Embodiment 1

Figure 1:
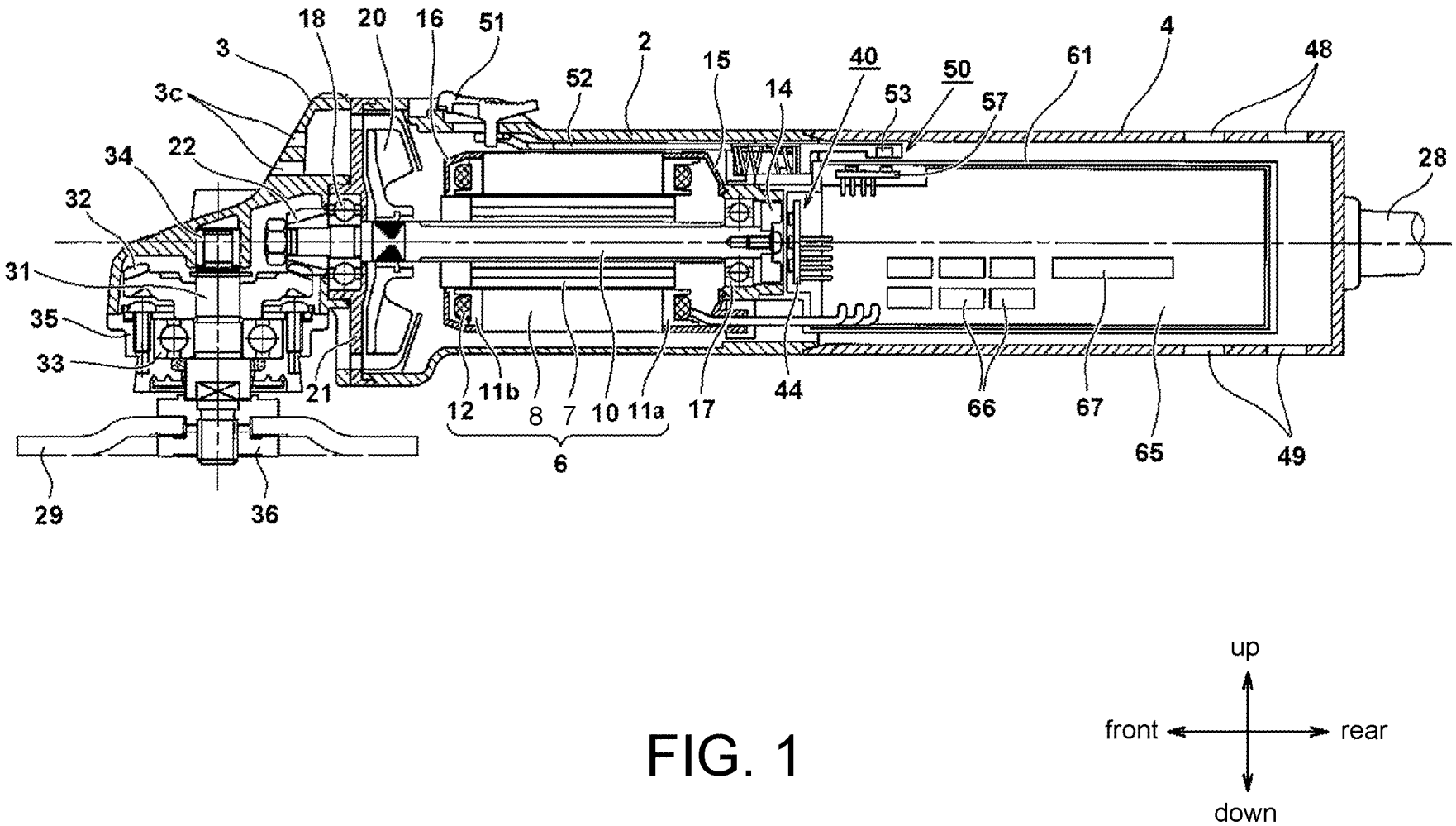
FIG. 1 is a longitudinal cross-sectional view illustrating an overall structure of an electric tool 1 according to an embodiment of the disclosure.

In the following, the embodiments of the disclosure are described with reference to the accompany drawings. In addition, in the following figures, components having the same functions are noted with the same reference numerals, and repeated descriptions are omitted. Moreover, in the description, directions of front, rear, left, right, up, and down are described based on the directions in the drawings.

FIG. 1 is a top view illustrating an electric tool 1 according to an embodiment of the disclosure. Here, as an example of the electric tool 1, an operating device connected to a rotation shaft of a motor is shown as a grindstone, for example, indicating that the device is a disc grinder. A casing (outer frame) of the electric tool 1 includes three main sections, namely a gear box 3 accommodating a power transmission mechanism, a motor casing 2 accommodating a motor 6, and a rear cover 4 installed behind the motor casing 2 and accommodating electronic elements. In this embodiment, the casing of the electric tool 1 is divided into three sections. However, the number of sections into which the casing is divided may be arbitrary. For example, it is plausible that the motor casing 2 and the rear cover 4 are not divided in the front-rear direction as in the embodiment, but are instead divided in the left-right direction on a vertical plane passing through a central axis in a lengthwise direction. Other configurations are also possible. The motor casing 2 is substantially in a cylindrical shape having an outer diameter slightly greater than the shape of the motor, and is configured to provide a part (gripping part) for an operator to hold single-handed. In addition, the motor casing 2 is integrally formed of resin or metal. Behind the motor casing 2, the rear cover 4 divided in the left-right direction on a vertical plane passing through the central axis in the lengthwise direction and having an enclosed rear side is installed. Electronic elements, such as a control circuit (controller) controlling rotation of the motor 6, an inverter circuit generating a three-phase alternate current (AC) supplied to a coil of the motor 6, and a rectifier circuit rectifying an externally supplied commercial alternate current (AC) via a power cord 28 into a direct current (DC), are accommodated in the rear cover 4.

The motor 6 is in an elongated shape in an axial direction (front-rear direction). The controller detects a rotational position of a rotor 7 by using a rotational position detection unit 40 using a Hall integrated circuit (Hall IC), and controls an inverter circuit having a plurality of switch elements 66, so as to supply driving power to a predetermined coil of the motor 6 in turn, thereby forming a rotational magnetic field to rotate the rotor 7. The motor 6 is a three-phase brushless DC motor, and is of the so-called internal rotor type where an inner circumferential part of a stator core 8 is substantially in a cylindrical shape for the cylindrical rotor 7 to rotate therein. A stator of the motor 6 includes the stator core 8, an insulator 11*a*, an insulator 11*b*, and a coil 12.

A rotation shaft 10 is rotably held by components as follows: namely, a bearing 17 (first bearing) fixed to a rear side of the motor casing 2 and a bearing 18 (second bearing) fixed at a proximity of a connection part between the gear box 3 and the motor casing 2. When observed in an axial direction of the rotation shaft 10, a cooling fan 20 is disposed between the bearing 18 and the motor 6. The cooling fan 20 is a centrifugal fan made of a plastic material, for example. If the motor 6 rotates, the cooling fan 20 also rotates synchronously with the rotation shaft 10, so as to generate a flow of a wind that cools off the motor 6 or the control circuit.

The gear box 3 is formed integrally by metal such as aluminum, accommodates a set of bevel gear mechanisms (22 and 23), and rotably holds a spindle 31 serving as an output shaft. The spindle 31 is configured to extend along a direction (up-down direction here) substantially orthogonal to a shaft line direction (front-rear direction here) of the rotation shaft of the motor 6. A first bevel gear 22 is disposed to a front end part of the rotation shaft 10. The first bevel gear 22 is engaged to a second bevel gear 32 installed to an upper side end part of the spindle 31. The second bevel gear 32 has a greater diameter as well as a greater number of teeth than the first bevel gear 22 does, so the power transmission units function as a deceleration mechanism. The upper end side of the spindle 31 is axially supported by a metal 34 to be rotatable, and the spindle 33 is axially supported around the center by a bearing 33 formed by a ball bearing. The bearing 33 is fixed to the gear box 3 by a spindle cover 35.

A disc-shaped tip tool is installed to a front end of the spindle 31 by using a washer nut 36. Here, an example where a grindstone 29 is installed as the tip tool is described. The grindstone 29 is, for example, a resinoid flexible grindstone, a flexible grindstone, a resinoid grindstone, a sanding disc, or the like, that has a diameter of 100 mm, for example. Based on a choice on the type of grind particles, surface grinding or curved surface grinding for metal, synthetic resin, marble, or cement concrete, etc., may be performed. In addition, the tip tool installed to the electric tool 1 is not limited to a grindstone, and may also be a bevel wire brush, a nonwoven brush, a diamond wheel, or the like.

On a rear end of the rotation shaft 10 of the motor 6, a magnetic body, namely a sensor magnet 14, having different magnetic polarities in a rotational direction is installed. The sensor magnet 14 is in a ring or cylindrical shape having a relatively thicker thickness (length in the front-rear direction), and is adapted to detect the position in the rotational direction by a magnetic detection element installed nearby, such as a Hall IC (to be described in the following) or Hall ICs, that is disposed. Here, the sensor magnet 14 and a plurality of Hall ICs mounted to the circuit substrate 44 form the rotational position detection unit 40 detecting a rotational position of the rotor 7. Three Hall ICs are mounted on the circuit substrate 44. Details in this regard will be described in the following.

On a control substrate 65, mainly the controller (control unit) controlling the rotation of the motor 6, the inverter circuit configured to drive the motor 6, and the rectifier circuit that converts an AC externally supplied via the power cord 28 into a DC are disposed. The inverter circuit that forms a motor driving circuit needs to feed a large driving current to the coil 12. For example, a high-capacitance output transistor, such as a field-effect transistor (FET) or an insulated gate bipolar transistor (IGBT) operable as the switch element 66 may be used. Due to a larger amount of heat generated, the switch elements 66 may be provided with a heat dissipation structure that facilitates a cooling effect, and may be disposed on a leeward side with respect to ventilating windows 48 and 49. Behind the switch elements 66, a rectifier circuit 67 that converts an AC into a DC is disposed. Considering wiring efficiency, the rectifier circuit 67 is mounted to a part on a rear side of a housing 61 and more distant from the motor 3 than the switch element 66 by being mounted near the power cord 28 (as shown in FIG. 1). The rectifier circuit 67 may be implemented as a full-wave rectifier circuit that uses a diode bridge and a capacitor, for example. However, the disclosure is not limited thereto. Other conventional rectifier circuits may also be used.

In the control substrate 65, the controller that controls the rotation of the motor 6 is also mounted. The controller is configured to include a microcomputer not shown herein. Here, the control substrate 65 is mounted in the housing 61 by extending along the front-rear and up-down directions with respect to the electric tool 1. In a space defined by the housing 61, two small circuit substrates (44 and 57) are disposed together with the control substrate 65. The circuit substrate 44 is mounted with the rotational position detection elements (Hall ICs 41 to 43 described in the following), whereas the circuit substrate 57 is mounted with elements forming a switch mechanism 50 (to be described in the following). The small circuit substrates (44 and 57) are disposed in a direction orthogonal to the control substrate 65. The circuit substrate 44 is disposed in extending directions along the up-down and left-right directions and is orthogonal to a direction of the rotation shaft. In addition, the circuit substrate 57 is disposed in extending directions along the front-rear and left-right directions and is parallel to the rotation shaft.

Regarding the switch mechanism 50, since the operator may start or stop the motor 6, the operator may set an ON state or an OFF state of the motor 6 by slidably moving the switch lever 51 along the front-rear direction. Considering the operability of the switch lever 51, the switch lever 51 is disposed to a front side of the gripping part of the motor casing 2, namely an upper part at a proximity of the motor 6, and moves along the front-rear direction within a wind path between the motor 6 and the motor casing 2. A plate-like movable arm 52 elongated in the axial direction is connected to the switch lever 51. By operating the switch lever 51, the movable arm 52 may move along the front-rear direction. When observed in the direction of the rotation shaft of the motor 6, on the rear side of the movable arm 52 and to the extent of overlapping with the housing 61, a small magnet 53 is disposed at a proximity of a rear end of the movable arm 52. By acting with respect to the magnetic detection units (be described in the following), such as the Hall ICs mounted to the circuit substrate 57, the magnet 53 may output an ON signal or OFF signal to the microcomputer from the Hall ICs.

Figure 2:
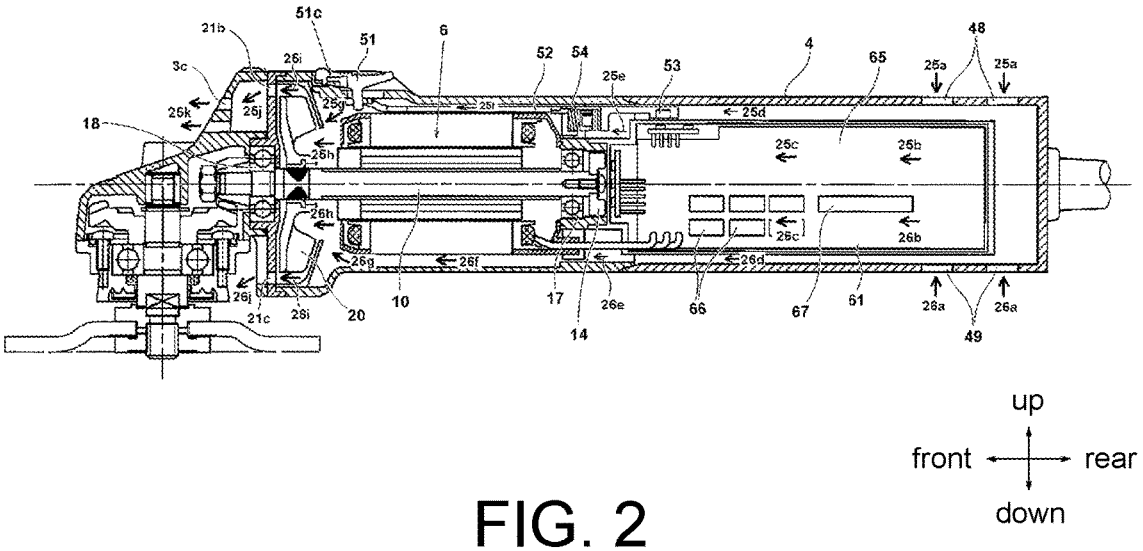
FIG. 2 is a longitudinal cross-sectional view illustrating the electric tool 1 according to an embodiment of the disclosure, and is a view illustrating flowing of a cooling wind when a trigger switch is in an ON state.

In the following, a flow of a cooling wind when the switch lever 51 is in the ON state is described with reference to FIG. 2. In FIG. 2, arrow signs indicate flowing of the wind when the switch lever 51 moves toward the front side and the motor 6 is started to make the cooling fan 20 rotate. If the cooling fan 20 rotates, the ventilating windows 48 and 49 formed on the rear cover 4 to suck an external gas may suck the external gas in directions indicated by arrow signs 25*a* and 26*a*. The external gas sucked as indicated by the arrow sign 25*a* may flow along a periphery of the housing 61 and a space (wind path) between the periphery and a wall surface of the rear cover 4 as indicated by arrow signs 25*b*, 25*c*, and 25*d*, and arrive at a proximity of the bearing 17 as indicated by an arrow sign 25*e*. The wind flows through a through hole formed at a rib part 19*a* (to be described in the following with reference to FIG. 4) in an outer circumferential part of the bearing 17 into a space in the motor casing 2, and flows in a space (wind path) between an outer circumferential surface on an outer circumferential side of the stator core 8 of the motor 6 and a wall surface of the motor casing 2 as indicated by an arrow sign 25*f*, and is concentrated in the direction of the rotation shaft 10 on a front side of the motor 6 as indicated by an arrow sign 25*g*, and flows into the cooling fan 20 as indicated by an arrow sign 25*h*. A cooling wind discharged by the cooling fan flows from the outer circumferential part of the cooling fan 20, as indicated by an arrow sign 25*i*, into an internal space on the side of the gear box 3 through a through hole formed at a bearing holder 21, as indicated by an arrow sign 25*j*, and is discharged outside through a ventilating window 3*c* formed on a front side of the bear box 3 as indicated by an arrow sign 25*k*. Here, the ventilating window 3*c* is an outlet of the casing of the electric tool 1. Similarly, the external gas sucked as indicated by an arrow sign 26*a* flows on the periphery of the housing 61 as indicated by arrow signs 26*b*, 26*c*, and 26*d*, passes through the outer circumferential part of the bearing 17 as indicated by an arrow sign 26*e*, and flows into the space in the motor casing 2 through a borderline position between the space on the rear side (controller side) and the space on the front side (motor side) by using the rib part 19*a* (to be described in the following with reference to FIG. 4). Then, the wind flows on the outer circumferential side of the stator core 8 of the motor 6 as indicated by an arrow sign 26*f*, and flows into the cooling fan 20 as indicated by an arrow sign 26*h* after being concentrated in the direction of the rotation shaft 10 on the front side of the motor 6 as indicated by an arrow sign 26*g*. Then, the wind is discharged outside from the outer circumferential part of the cooling fan 20, as indicated by an arrow sign 26*i*, through a through hole 21*c* formed at the bearing holder 21, as indicated by an arrow sign 26*j*. Here, the air flow indicated by the arrow signs 26*b* to 25*g* and 26*b* to 26*i* is not specifically separated. The air sucked from the ventilating windows 48 and 49 are mixed to flow along the wind path from the leeward side toward the windward side. In this embodiment, when observed on the shaft line of the rotation shaft 10 of the motor 6, from the rear (windward) side toward the front side, the control substrate 65, the sensor magnet 14, the bearing 17, the motor 6, the cooling fan 20, and the bearing 18 are configured in a serial arrangement (i.e., arranged on a straight line). In addition, the ventilating windows 48 and 49 as inlets of the external gas are disposed on a periphery of the control substrate 65 and disposed closer to the rear side than elements generating more heat (the switch elements 66 herein), so that the heat may be discharged through the ventilating windows (3*c* and 21*c* herein) as the outlets of the external gas. In this way, in the embodiment, when observed in the direction of the rotation shaft of the motor 6, the cooling wind flows in a way of being substantially coupled to a whole outer circumferential surface of a front side end part from a rear side end part of the stator core 8.

Figure 14:
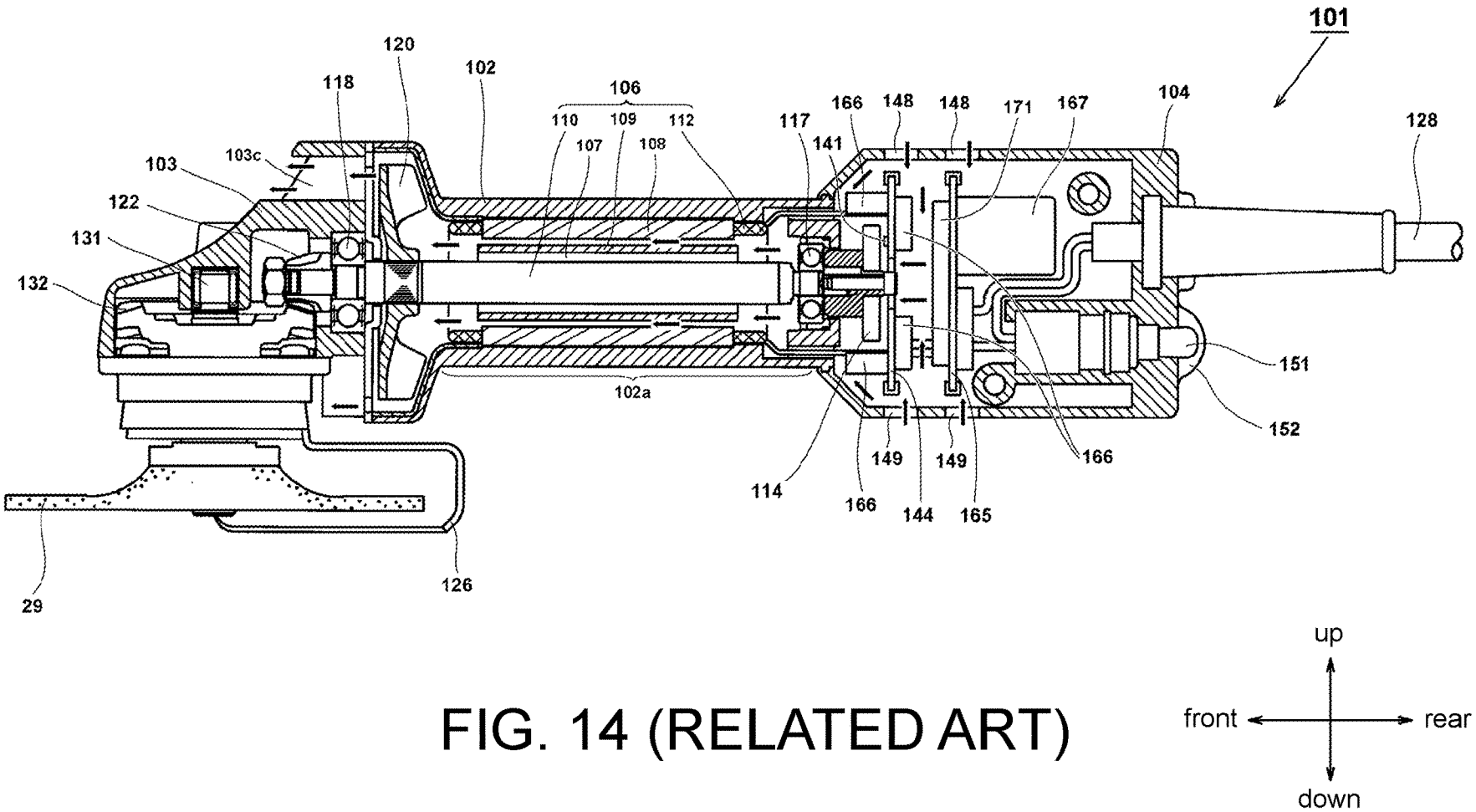
FIG. 14 (RELATED ART)
FIG. 14 is a longitudinal cross-sectional view illustrating a conventional electric tool 101.

Since the switch elements 66 or the rectifier circuit 67 may show a significant increase in temperature when operating, where and how the switch elements 66 or the rectifier circuit 67 are mounted are designed by taking the cooling effect into consideration. Here, the plurality of ventilating windows 48 and 49 are disposed closer to the rear side than the switch elements 66, so the electronic elements generating a greater amount of heat are properly exposed on the wind paths of the cooling wind. Besides, considering moisture and dust resistances, the control substrate 65 is completely covered by resin, such as silicon. Structural details in this regard will be described in the following. Here, it is configured such that, in the motor casing 2, the cooling wind may flows along the wind path on an outer circumferential side of the motor 6 (a space between an outer side of the stator core 8 and an inner side of the motor casing 2 when observed in a radial direction). Accordingly, the cooling wind does not flow within a space between the stator core 8 and the rotor 7 as shown in FIG. 14. Thus, it is configured such that, on an upstream side (rear side) when observed from the motor 6, the cooling wind does not flow into the part of the bearing 17 or the sensor magnet 14, and it is configured such that on a downstream side (front side) of the motor 6, the cooling fan is prevented from entering the space between the stator core 8 and the rotor 7 as much as possible. In the following, details concerning the configuration are described with reference to FIG. 3.

Figure 3:
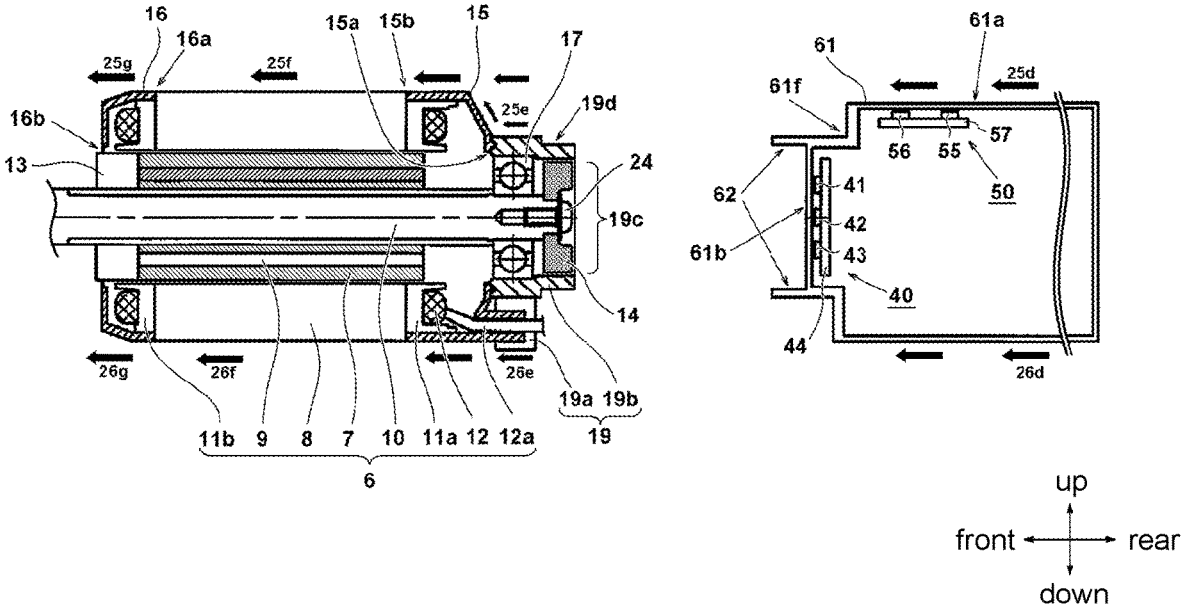
FIG. 3 is a view illustrating a connection structure of a motor part and a housing of FIG. 1.

FIG. 3 is a view illustrating a connection structure of the motor part and the housing. The motor 6 used herein is referred to as the so-called brushless DC motor. Also, on the outer circumferential side, the stator core 8 formed by a laminated iron core is disposed, and on an inner circumferential side of the stator core 8, the rotor 7 in a cylindrical shape is disposed. The stator core 8 is manufactured by forming a laminated structure where a plurality of ring-shaped thin iron plates manufactured by performing a pressing process are laminated in the axial direction. On the inner circumferential side of the stator core 8, six teeth (not shown) are formed. In an axial direction of each tooth, the insulators 11*a* and 11*b* made of resin are installed in the front-rear direction. A coil 12 is formed by winding a copper wire in a way that the teeth is sandwiched by the insulators

11*a* and 11*b*. In this embodiment, it is preferred that the coil 12 is a three-phase start-connection wiring having an U phase, a V phase, and a W phase, so as to be pulled out of the motor 6 to three lead wires 12*a* that supply the driving power to the coil 12. On the inner circumferential side of the stator core 8, the rotor 7 is fixed to the rotation shaft 10. The rotor 7 is formed by inserting a plate magnet 9 having an N polarity and an S polarity into a slit part having a rectangular-shaped cross-section and formed in parallel with the axial direction in a rotor core formed by laminating a plurality of ring-shaped thin iron plates manufactured by performing a pressing process in the axial direction.

A rear side of the rotation shaft 10 is axially supported by the bearing 17. On the rear end of the rotation shaft 10, the sensor magnet 14 for detecting the rotational position of the rotor 7 is fixed by a screw 24. The sensor magnet 14 is a permanent magnet in a thin cylindrical shape installed to detect the rotational position of the rotor 7, where polarities of N, S, N, S are formed in order with an interval of 90° in a circumferential direction. On a rear side of the sensor magnet 14 and in the housing 61, the circuit substrate 44 substantially in a semi-circular shape is disposed in a direction perpendicular to the rotation shaft 10. The Hall ICs 41 to 43 serving as the rotational position detection elements detecting the position of the sensor magnet 14 are disposed to the circuit substrate 44. Based on changes of the magnetic field of the rotating sensor magnet 14, the Hall ICs 41 to 43 may detect the rotational position of the rotor 7. The Hall ICs 41 to 43 are disposed in the rotational direction with a predetermined angle as a unit. Here, three Hall ICs are disposed with 60° as a unit. In a conventional electric tool 101 shown in FIG. 14, a sensor magnet 114 is disposed to be directly opposite to a Hall IC 141. However, in this embodiment, the sensor magnet and the Hall ICs are disposed to be opposite to each other, but are separated by a front wall 61*b* of the non-magnetic housing 61. In the housing 61, two Hall ICs 55 and 56 forming the switch mechanism 50 are disposed on the circuit substrate 57 and accommodated side-by-side in a lengthwise direction of the motor casing 2. An upper wall 61*a* of the housing 61 is also disposed between the Hall ICs 55 and 56 and the magnet 53 (see FIG. 1) opposite to the Hall ICs 55 and 56. The magnet 53 acts with respect to the Hall ICs 55 and 56 through the upper wall 61*a*.

An outer wheel of the bearing 17 is held by a bearing holder 19*b* in a cylindrical shape. The bearing holder 19*b* serves to fix the outer wheel part of the bearing 17 and covers a cover member disposed on an outer side of a radial direction of the sensor magnet 14 disposed on a rear side of the bearing 17, and functions together with the rib part 19*a* as a bearing holding part 19. An opening part 19*c* on a rear side of the bearing holder 19*b* is enclosed by a cup-shaped covering part (a concave part formed by a cylindrical part 62 and the front wall 61*b*) formed on a front end of the housing 61. To form the covering part (cap unit), a part on a front side of the housing 61 indicated by an arrow sign 61*f* has a smaller width in the up-down direction to be capable of fitting a width of the bearing holder 19*b*. The covering part is configured to completely cover from a central axis of the bearing 17 to an extent closer to an outer side than an outer diameter position. The cup-shaped covering part is installed to the bearing holder 19*b*, and serves not only to block the part of the bearing 17 to avoid exposure to the cooling wind, but also to position the front side of the housing 61 for fixing. The bearing holder 19*b* is installed to the through hole of the rib part 19*a* protruding toward an inner side of a radial direction of the motor casing 2. On the rear side, a small diameter part 19*d* to be fit with the cylindrical part 62 is formed. A plurality of ventilating windows are formed in the rib part 19*a* to allow the cooling wind to flow from the side of the rear cover 4 toward the side of the motor casing 2, and the wind flows as indicated by the arrow signs 25*e* and 26*e*. Here, the bearing holding part 19 is formed by two separate components, i.e., the rib part 19*a* and the bearing holder 19*b*. However, the rib part 19*a* and the bearing holder 19*b* may also be integrally formed. Besides, the whole bearing holding part 19 and the motor casing 2 may also be formed integrally or formed as separate components.

A first cover member 15 made of synthetic resin and integrally formed covers between a front side of the bearing holder 19*b* and an outer edge at the rear of the stator core 8. Accordingly, the wind is blocked as the cooling wind flowing as indicated by the arrow signs 25*e* and 26*e* does not enter the space between the stator core 8 and the rotor 7 from the rear side. On a rear side of the cover 15, a small diameter opening part 15*a* is formed, and on a front end, a large diameter opening part 15*b* is form, making the cover member 15 a sleeve-like windguide plate substantially in a cylindrical shape. In addition, the cover member 15 is made of a non-magnetic material and formed integrally. A preferred material of the cover member 15 is a plastic material, such as synthetic resin, as such material is light-weighted and has a lower manufacturing cost. On a surface of the opening part 15*a* of the cover member 15 contacting the bearing holder 19*b*, a convex part is continuously formed in a circumferential direction and protrudes toward the rear of the axial direction. Besides, on a ring-shaped surface on the rear side of the bearing holder 19*b*, a slot-like concave part corresponding to the convex part of the cover member 15 is continuously formed in a circumferential direction. Accordingly, by using the bearing holder 19*b* and the stator core 8, the cover member 15 is sandwiched in a state where the convex part of the cover member 15 contacts the concave part of the bearing holder 19*b*. Accordingly, the cooling wind can be effectively prevented from flowing into the motor 6 from this part. Besides, with regard to the convex part of the cover member 15 and the concave part of the bearing holder 19*b*, directions of convex and concave may be reversed. Besides, further to having the convex part of the cover member and the concave part of the bearing holder 19*b* contact each other, the convex part and the concave part may be sealed with an adhesive or resin.

The opening part 15*b* on a front side of the cover member 15 is pressed against an outer circumferential side of the insulator 11*a*, so that the stator core 8 and the cover member 15 are properly sealed to prevent the cooling wind from flowing into the motor 6 from this part. Accordingly, the air sucked from the side of the rear cover 4 is directed to an outer circumferential part of the stator core 8, and the cooling wind flows along an outer circumferential surface from the rear to the front in the axial direction. Accordingly, an internal space of the motor 6 can be effectively isolated from the wind path (i.e., the space between the motor casing 2 and the outer circumferential surface of the stator core 8) of the cooling wind. Moreover, since the space accommodating the bearing 17 is also isolated from the cooling wind, malfunctioning of the bearing 17 caused by dust can be prevented.

At the end part on the front side of the stator core 8, a second cover member 16 is disposed. An opening part 16*a* on a rear side of the cover member 16 is pressed against the insulator 11*b* by being fit into the insulator 11*b* on an outer circumferential side of the insulator 11*b* and the front side of the stator core 8, so as to seal and thereby suppress the cooling wind from flowing into the motor 6 from this part. A front side of the cover member 16 is designed to be narrowed along the axial direction and formed with an opening part 16*b* setting separation with a small gap from an outer circumferential surface of a balance weight 13 substantially in a cylindrical shape and disposed to the rotation shaft 10. The balance weight 13 is a mass body disposed to balance a rotational part of the motor 6. By setting apertures for mass adjustment at a plurality of parts in the rotational direction during manufacturing and assembling, adjustment is made so that the rotor 7 may smoothly rotate without shaking. In this embodiment, the opening part 16*b* of the cover member 16 is disposed to be close to an outer circumferential side of the balance hammer 13, so that the cooling wind does not enter an internal space of the rotor 7. Therefore, the opening 16*b* may also be disposed closer to the rotation shaft 10 than a front side of the balance weight 13 and serve as a through hole for the rotation shaft 10 to penetrate through. In addition, the opening part 16*b* of the cover member 16 is formed without being overly close to a rotation body rotating with the rotor 7, and does not come into contact with the rotation body. However, a part that is close is located on the leeward side of the cooling wind, and the cooling fan 20 is disposed immediately in front of the opening part 16*b*, so as to substantially prevent the cooling wind from flowing into the internal space of the motor 6 from the opening part 16*b*. Thus, around a periphery of the motor 6, the cooling wind flows as indicated by the arrow signs 25*e* to 25*g* as well as the arrow signs 26*e* to 26*g*. Therefore, inside the motor 6, not only the cooling wind is effectively suppressed, but iron powder or dust transported by the cooling wind may also be prevented from being mixed into the internal space of the motor 6. Accordingly, front and rear end parts of the motor 6 are in a state of being isolated from the wind path of the cooling wind because of coverage of the cover members 15 and 16, the bearing holder 19*b*, and the front wall 61*b* of the housing. Details in this regard are further described in FIG. 4.

Figure 4:
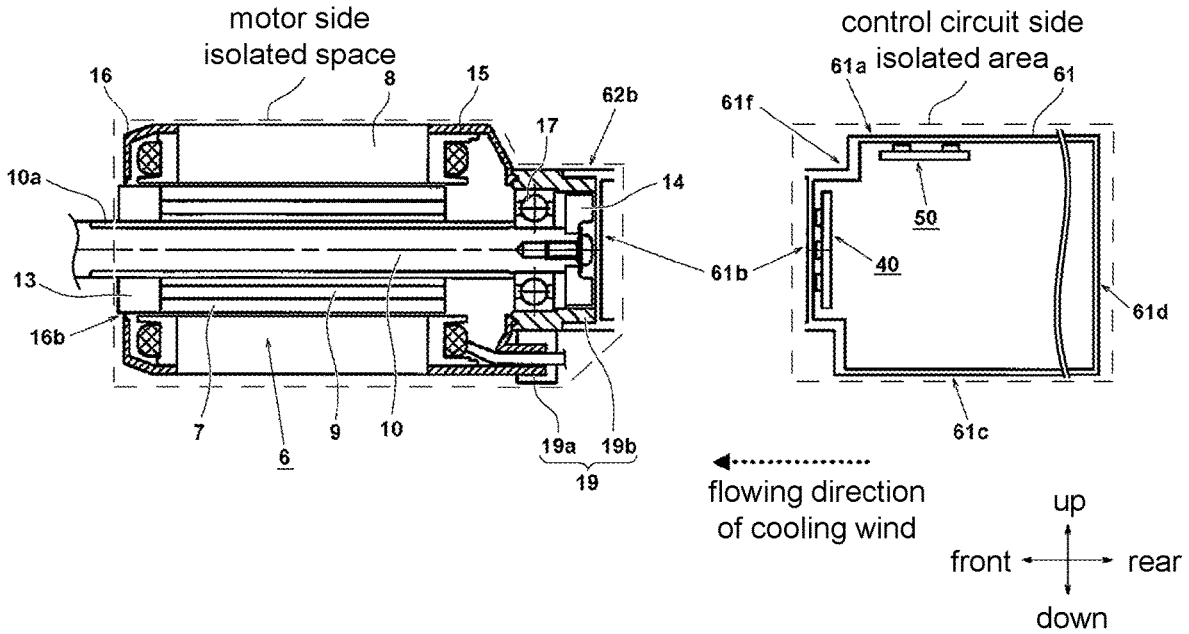
FIG. 4 is a view illustrating a relation between a motor side isolated space and a control circuit side isolated area of FIG. 1.

FIG. 4 is a view illustrating a relation between a motor side isolated space and a control circuit side isolated area of the electric tool 1. In this embodiment, the motor side isolated space is formed by having the cover member 16 cover the front side of the motor 6, and the cover member 15, the bearing holder 19*b*, and the front wall 61*b* of the housing 61 cover a rear side of the motor 6. Accordingly, the motor 6 is partially set as a space isolated from the wind path of the cooling wind, so that the cooling wind does not flow to the magnetic polarities of the stator core 8 that generate the magnetic field, the rotor 7 having the magnet 9, or the respective parts of the sensor magnet 14. Therefore, dust, such as magnetic powder, can be prevented from being sucked and attaching to these components. Particularly, if the magnetic powder, such as iron powder, is temporarily attached to a proximity of the magnet 9, the powder is not discharged outward even if the rotation of the motor 6 is stopped. Thus, a cause resulting attachment itself is effectively prevented. Besides, the circuit substrates 44 and 57 are accommodated in the housing 61 in addition to the control substrate 65 and configured on the control circuit side. For most of the electronic elements mounted to these components, specifically excluding those that need exposure to the cooling wind for heat dissipation, all the elements are filled with resin, such as silicon, and consolidated, so as to be substantially prevented from exposure to the cooling wind. The housing 61 is a rectangular frame body, and forms a shape of a container with only one side removed, and is configured such that the removed side (opening side) faces toward the left side. On an inner side of the upper wall 61*a*, a detection element of the switch mechanism 50 is disposed, and on an inner side of the front wall 61*b*, a detection element of the rotational position detection unit 40 is disposed. No element forming the rotational position detection unit 40 or the switch mechanism 50 is disposed at a proximity of a lower wall 61*c* or a rear wall 61*d*. With such configuration, even if moisture enters from outside with the cooling wind, the moisture is not attached to the electronic elements. Thus, long-term and stable operations of the control unit, the rotational position detection unit, and the switch unit are anticipated, and the lifetime of the electric tool 1 may be significantly increased.

Figure 5:
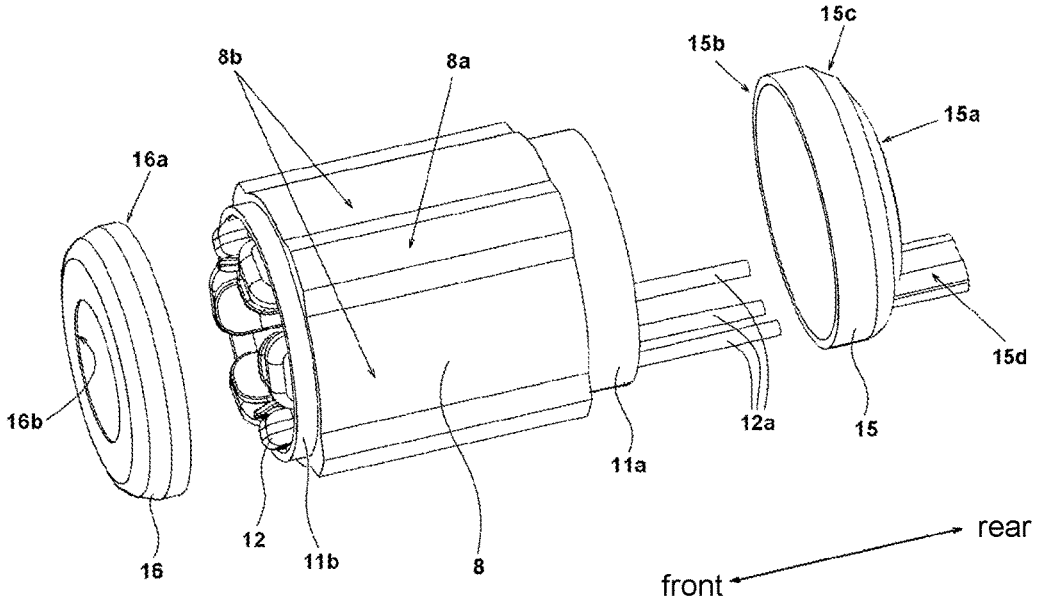
FIG. 5 is an exploded perspective view illustrating installation structures of cover members 15 and 16 installed to a motor 6 of FIG. 1.

FIG. 5 is an exploded perspective view illustrating installation structures of the cover members 15 and 16 installed to the motor 6. The stator core 8 is manufactured based on a conventional laminated structure, so as to form a convex part 8*a* formed continuously in parallel with the axial direction on an outer circumferential side of the stator core 8 in a way that is effectively fixed on the inner side of the motor casing 2. Four convex parts 8*a* are formed in a circumferential direction with an interval of 90°. By forming the convex parts 8*a*, it becomes easier to hold the rotor 7 to prevent deviation toward the rotational direction with respect to the casing. Besides, in an outer circumferential part of the rotor 7, a predetermined space between an outer circumferential surface 8*b* excluding the convex parts 8*a* and an inner wall of the motor casing 2 is ensured, thereby forming the wind path for the cooling wind to flow in the space. In addition, to improve cooling performance of the motor 6, a plurality of heat dissipation fins may also be formed on the outer circumferential surface 8*b*. The cover member 15 is installed to the rear (windward) side of the stator core 8, and the cover member 16 is installed on the front (leeward) side. A portion of the cover member 15 from the opening part 15*a* on the windward side to the opening 15*b* in the leeward side expands in a taper shape (a taper part 15*c*). The flow of the cooling wind is directed, so that the cooling wind flowing along an outer circumferential side of the bearing 17 is guided toward an outer side of a radial direction to an outer circumferential part of the motor 6. Here, the coil 12 of the motor 6 is connected to the three lead wires 12*a* providing a three-phase driving voltage. Therefore, to allow the lead wires 12*a* to penetrate through, a cylindrical wiring hole 15*d* extending along the axial direction is formed at a location in the circumferential direction of the cover member 15.

In the following, an assembling method of the motor casing 2 of the motor 6 is described. The motor casing 2 is an integrally formed article made of metal or synthetic resin, and is manufactured without a cut surface parallel with the axial direction. The rib part 19*a* of the bearing holding part 19 and the motor casing 2 are integrally formed. Therefore, the bearing 17 and the sensor magnet 14 are installed to the rotation shaft 10, and the cover members 15 and 16 are installed in the front-rear direction to the stator core 8 formed by winding the coil 12 around the insulators 11*a* and 11*b*, so as to form a temporary assembly. Then, these assembly components are inserted into the rear side from the opening of the motor casing 2 on the front side. The cover member 15 is positioned to a position contacting the front surface of the rib part 19*a*. In addition, the bearing holder 19*b* is fixed by the rib part 19*a*. By adopting the assembling method, the motor casing 2 is provided with a thinner appearance and a higher rigidity.

Figure 6:
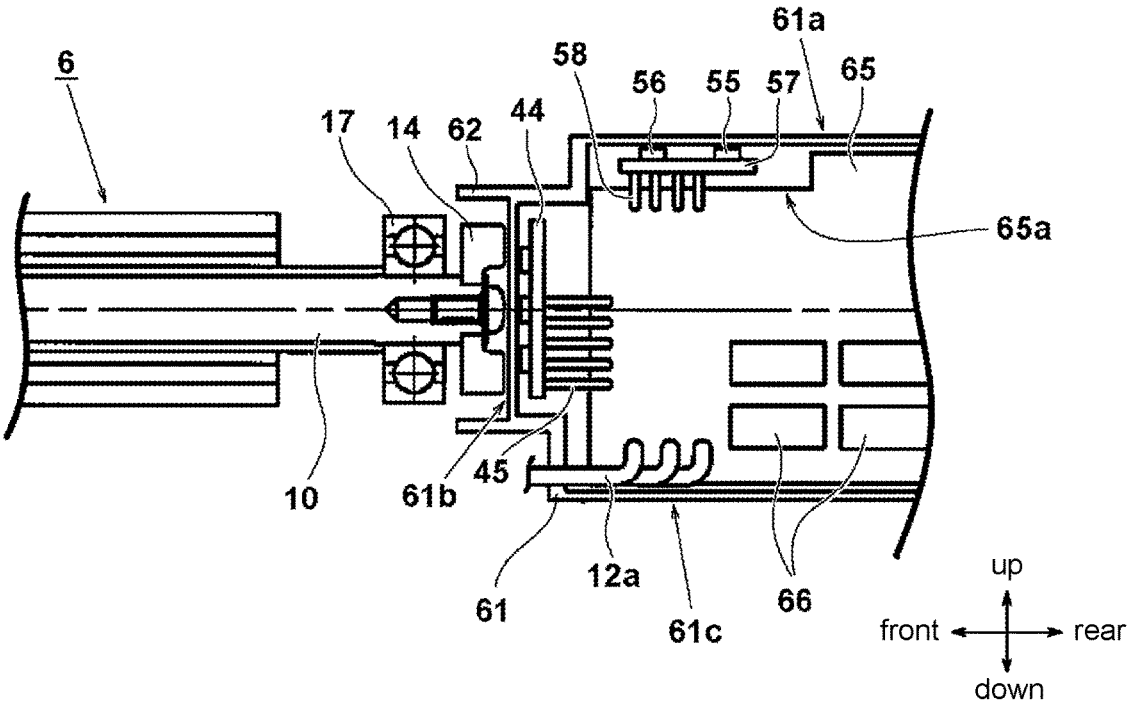
FIG. 6 is a partial cross-sectional view illustrating a configuration at a proximity of a rotational position detection unit of FIG. 1.

FIG. 6 is a partial cross-sectional view for describing a configuration at a proximity of the rotational position detection unit 40 of the embodiment. The sensor magnet 14 is located in the motor side isolated area, and the circuit substrate 44 mounted with the Hall ICs are located in the control circuit side isolated area, since the circuit substrate 44 is accommodated in the housing 61. The control circuit 65 is mounted in the housing 61. The circuit substrate 44 and the control substrate 65 are disposed separately for the convenience of being arranged at an optimal position opposite to the sensor magnet 14. The circuit substrate 44 and the control substrate 65 are connected by a plurality of lead wires 45, so it remains desirable even if the distance is short. Therefore, in addition to reducing the influence of noise, the circuit substrate 44 may also be assembled with the control substrate 65. The lead wire 12*a* extending from the coil 12 of the motor 6 is connected to the control substrate 65. The control substrate 65 is a circuit substrate configured to mount a control circuit such as the microcomputer, a single-layer or multi-layer printed substrate may be adopted. The circuit substrate 57 mounted with the Hall ICs for the switch mechanism 50 is disposed separately from the control substrate 65, and is in an arrangement orthogonal to the control substrate 65. To arrange the control substrate 65, a notch 65*a* is formed at a portion of the control substrate 65. The circuit substrate 57 is accommodated at the portion. The control substrate 65 and the circuit substrate 57 are connected by a plurality of lead wires 58.

Figure 7:
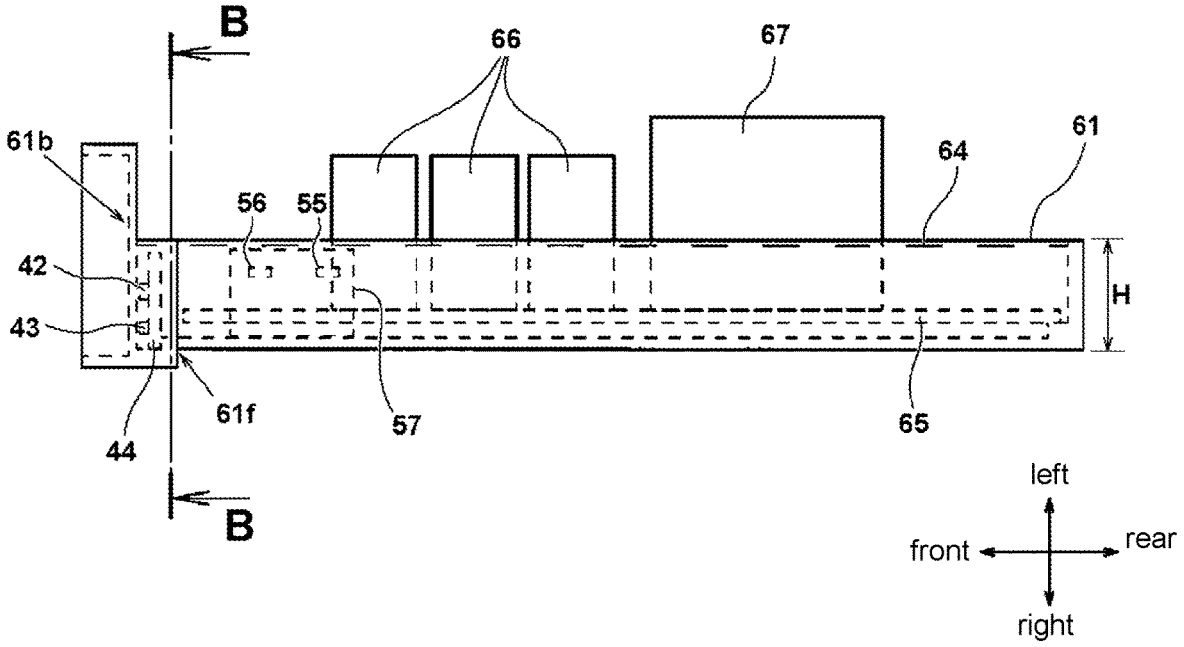
FIG. 7 is a bottom view illustrating a state of configuration of a shape of a housing 61 of FIG. 1 and a substrate or an electronic element.

FIG. 7 is a bottom view of a portion of the housing 61. The housing 61 is configured in a shape as follows. A small-diameter accommodating part substantially in a cylindrical shape and configured to arrange the circuit substrate 44 is formed on the front side, and a container in a rectangular shape having an opening on only one side is connected to a rear side of the cylindrical shape. Regarding the housing 61, it is essential that the housing 61 is made of a non-magnetic material. Here, the housing 61 is made of synthetic resin manufactured through integral formation. The control substrate 65 is mounted to be parallel with a bottom surface (the surface having the largest area) of the housing 61. The switch elements 66 are mounted in the control substrate 65. On the rear side of the switch elements 66, components forming the rectifier circuit 67 are mounted. Here, as can be told through illustration of FIG. 7, a height H is lower than a height of the switch element 66 or the rectifier circuit 67 under a condition that the housing 61 is considered as a container. However, the height H is sufficient for electronic elements, such as a microcomputer, an IC, a capacitor, and a chip resistor, etc., accommodated and mounted to the control substrate 65. In this embodiment, by arranging an opening surface of the container-like housing 61 to be an upper side, a melt silicon 64 is injected into the housing 61, so that the space in the housing 61 is consolidated with the silicon 64. A liquid surface of the silicon 64 just injected is only as high as half of the height of the switch element 66. However, even if a filling only as high as a half of the switch element is sufficient to completely cover a metal-made pin part of the FET, for example, to prevent moisture from being attached to the metal part. Besides, if the part of a heat dissipation plate of the FET is exposed externally with respect to the liquid surface of the silicon 64, a preferable heat dissipation effect is ensured. Moreover, if silicon or other resin is thinly coated on the heat dissipation plate of the FET, the moisture resistance can be ensured while maintaining preferable heat dissipation properties. Similarly, the rectifier circuit 67 may also be partially exposed externally with respect to the silicon 64. Accordingly, the electric tool 1 as follows is achieved. Namely, the switch element 66 and the rectifier circuit 67 are exposed partially, instead of completely, and rest of the electronic elements are covered through complete immersion into the resin. Therefore, in addition to making it easier to integrate components mounted in the housing 61 into a single component, i.e., a control assembly unit, the moisture and dust resistances are also preferable, and vibration resistance during operation is high, too. Besides, the resin filled into the housing 61 and consolidated is not limited to silicon. Other resin or materials capable of being solidified are also applicable.

Figure 8:
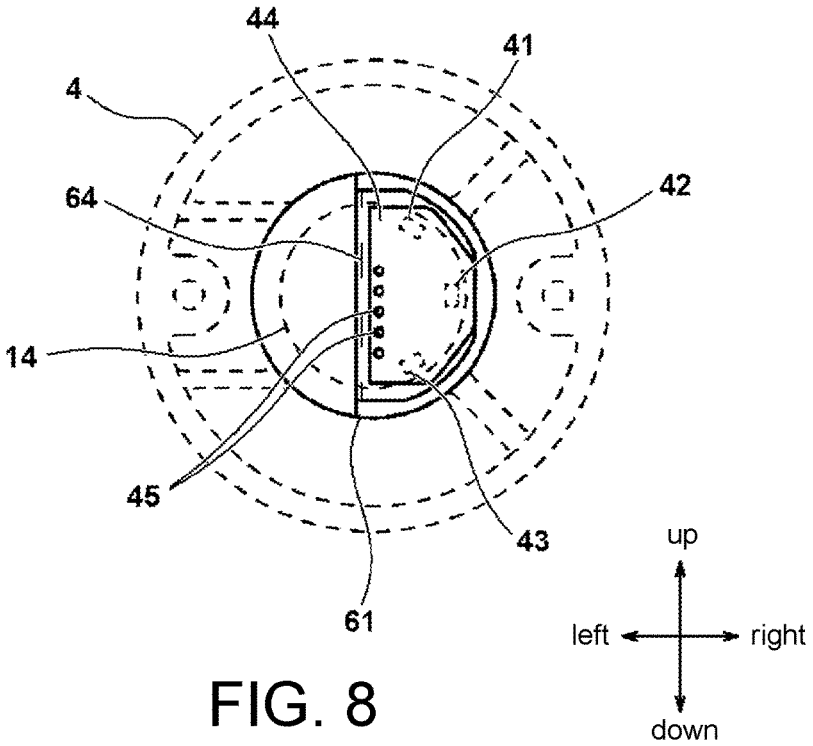
FIG. 8 is a cross-sectional view of a B-B part of FIG. 7.

In the embodiment, the circuit substrate 57 mounted with the Hall ICs 55 and 56 and the circuit substrate 44 mounted with the Hall ICs 41 to 43 are arranged to be completely contained the part filled with the silicon 64. Accordingly, the Hall ICs are also consolidated by the silicon 64. Therefore, at a relative position of the sensor magnet 14 or the switch mechanism 50 relative to the magnet 53, no variation such as position deviation occurs on a detection device side, so a detection mechanism stably operable in a long term can be provided. Here, FIG. 8 is a view describing a cross-sectional shape of a B-B part. In the housing 61, a width closer to the rear than a stepped part 61*f* (a part in the up-down direction when arranged) is formed to be wider. However, a width of a side closer to the front than the stepped part 61*f* is formed to be narrower in order to store the circuit substrate 44 and be fit with the bearing holder 19*b*. A cross-section A-A is a cross-section at a position with the narrower width, and FIG. 8 illustrates the state thereof.

FIG. 8 is a cross-sectional view of the B-B part of FIG. 7. In the B-B part, a shape of a cross-section of the housing 61 is hemispherical, instead of quadrilateral. The hemispherical shape so formed serves to be fit with the cover member covering a windward side of the bearing 17. In the circuit substrate 44, the Hall ICs 41 to 43 are arranged intermittently with an interval of a rotational angle of 60° in a circumferential direction, so as to form a substantially hemispherical shape corresponding to the sensor magnet 14. Accordingly, the Hall ICs 41 to 43 may be arranged at positions optimal with respect to a position of the sensor magnet 14. Here, after filling and solidification of the silicon 64, the opening surface of the housing 61 is arranged to face a side surface, and the control substrate 65 not shown in FIG. 8 is arranged in a vertical state extending along the front-rear and up-down directions. Since the diameter of the motor casing 2 is formed to be significantly greater than that of the housing 61 of the B-B cross-sectional part, the cooling wind path transmitting the cooling wind from the periphery of the control circuit side isolated area toward the periphery of the motor side isolated space in a preferable efficiency can be ensured, as shown in FIG. 4.

Figure 9:
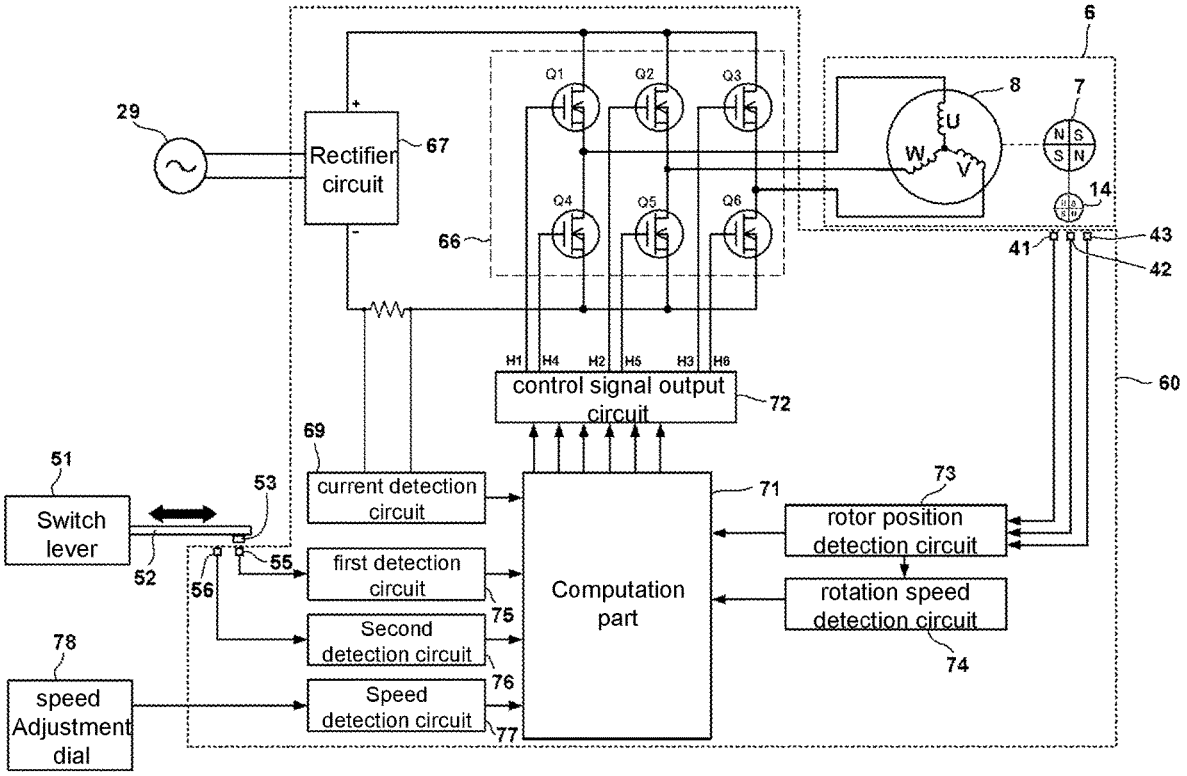
FIG. 9 is a view of a framework illustrating a circuit configuration of a driving control system of the motor 6 of FIG. 1.

In the following, a configuration and function of a driving control system of the motor 6 are described based on FIG. 9. FIG. 9 is a view of a framework illustrating the configuration of the driving control system of the motor 6. The motor 6 includes the so-called internal rotor type three-phase brushless DC motor. The motor 6 includes: the rotor 7 including a plurality of sets (two sets in the embodiment) of permanent magnets of N and S polarities; the stator core 8 including the three-phase stator coils U, V, and W in the wiring of star-connection; and the three Hall ICs 41 to 43 configured in the circumferential direction based on a predetermined interval, such as an angle of 60°, to detect the rotational position of the rotor 7. Energization directions and time of the stator coils U, V, and W are controlled based on position detection signals from the Hall Ics 41 to 43.

Even though it is not shown herein, a computation part 71 includes a microcomputer configured to output a driving signal based on a processing procedure and data. In addition, the microcomputer includes a read only memory (ROM)

configured to store a processing procedure or control data, a random access memory (RAM) configured to temporarily store data, and a timer, etc. Based on a rotation speed of the motor 6 set by a speed adjustment dial 78 detected by a speed detection circuit 77 and an output signal of a rotor position detection circuit 73, the computation part 71 forms a driving signal that alternately turns on a predetermined switch element 66, and the driving signal is output to a control signal output circuit 72. Accordingly, predetermined coils of the stator coils U, V, and W are energized alternately, such that the rotor 7 may rotate in the rotational direction that is set. A rotation speed detection circuit 74 calculates a rotation speed of the motor 6 based on an output of the rotor position detection circuit 73 and output the rotation speed of the motor 6 to the computation part 71. A current value supplied to the motor 6 is adjusted by measuring the current value by a current detection circuit 69, and feeding the value to the computation part 71 as the driving power and the rotation speed that are set.

The electronic elements mounted in the control substrate 65 (see FIG. 7) includes six switch elements 66, such as FETs connected in the form of three-phase bridge. Respective gates of the six switch elements (Q1 to Q6) connected by the bridge are connected to the control signal output circuit 72. Respective drains or sources of the switch elements 66 are connected to the stator coils U, V, and W of the star-connection wiring. Accordingly, by using switch elements driving signals (i.e., driving signals such as H4, H5, and H6) input from the control signal output circuit 72, the switch elements 66 perform switch operations. A DC voltage applied from the rectifier circuit 67 to the inverter circuit are set to be three-phase (i.e., U phase, V, phase, and W phase) voltages Vu, Vv, and Vw and supply power to the stator coils U, V, and W.

Q4, Q5, and Q6 of three negative side switch elements of the switch elements 66 in the switch element driving signals (three-phase signals) driving the respective gates of the switch elements 66 may be supplied as pulse width modulation signals H4, H5, and H6. The computation part 71 changes bandwidths (duty ratio) of the PWM signals, so as to adjust an amount of the power supplied to the motor 6, thereby exerting control to start and stop the motor 6 and the rotation speed of the motor 6.

Here, the PWM signals are supplied to one of Q1 to Q3 of positive side switch elements and Q4 to Q6 of the negative side switch elements of the switch elements 66 of the inverter circuit including the switch elements 66. By rapidly switching Q1 to Q3 of the switch elements 66 or Q4 to Q6 of the switch elements 66, the power supplied from the DC voltage of the rectifier circuit 67 to the respective stator coils U, V, and W is controlled. Besides, in this embodiment, Q4 to Q6 of the negative side switch elements 66 are supplied with the PWM signals, the power supplied to the respective stator coils U, V, and W are capable of being adjusted by controlling the bandwidths of the PWM signals, thereby controlling the rotation speed of the motor 6. Besides, the PWM signals may also be applied to Q1 to Q3 of the positive side switch elements 66.

If the operator operates the switch lever 51, the movable arm 52 may move in directions indicated by an arrow sign. Regarding a moving state of the switch lever 51, the position of the magnet 53 disposed to the movable arm 52 may be detected by using the Hall IC 55 or the Hall IC 56, so that the computation part 71 may perform detection. When the magnet 53 approaches the Hall IC 55 (a state shown in FIG. 10), an output of the Hall IC 55 is HIGH, whereas an output of the Hall IC 56 is LOW. Therefore, a first detection circuit 75 and a second detection circuit 76 detect the state of the Hall ICs 55 and 56 and output the state to the computation part 71. Alternatively, in a state when the magnet moves to approach the side of the Hall IC 56 (a state shown in FIG. 2), the output of the Hall IC 56 is HIGH, and the output of the Hall IC 55 is LOW. Accordingly, the computation part 71 is capable of performing electrical detection on the state of a trigger switch by detecting the outputs of the two Hall ICs 55 and 56. Besides, since the detection is conducted by controlling two Hall ICs, instead of one Hall IC, the switch mechanism is of a high reliability. A control part 60 includes the Hall ICs 41 to 43, the Hall IC 55 and the Hall IC 56, the switch elements 66, the rectifier circuit 67, the current detection circuit 69, the computation part 71, the control signal output circuit 72, the rotor position detection circuit 73, the rotation speed detection circuit 74, the first detection circuit 75, the second detection circuit 76 and the speed detection circuit 77. The control part 60 controls the motor.

Figure 10:
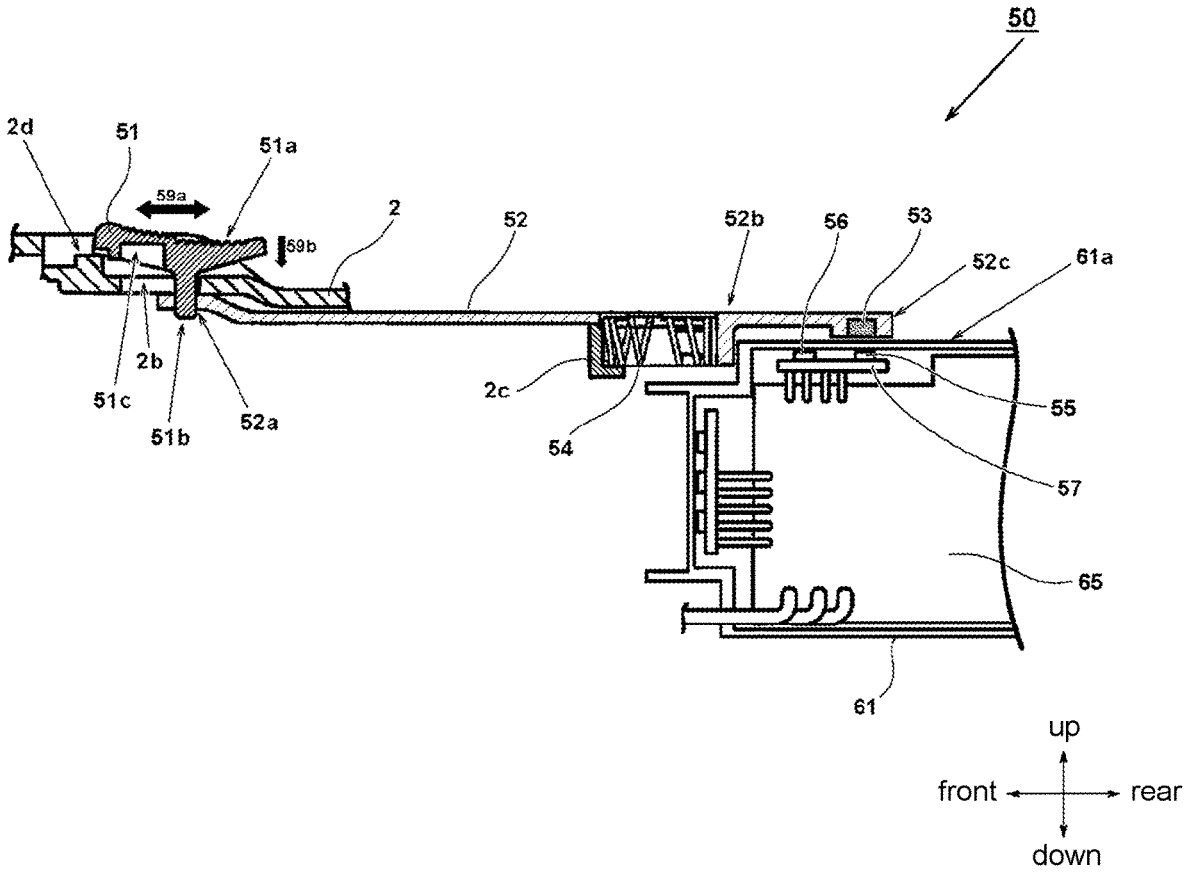
FIG. 10 is a partial cross-sectional view illustrating a configuration of a switch mechanism 50 of FIG. 1.

FIG. 10 is a partial cross-sectional view illustrating a configuration of the switch mechanism 50 of FIG. 1. If roughly divided, the switch mechanism 50 includes two main parts, namely an operation part exposed externally and a detection part detecting an operation of the operation part. The operation part has the switch lever 51, a movable part connected to the switch lever 51 to be movable in the front-rear direction through operation of the switch lever 51. The magnet 53 is installed to a rear end of the movable arm 52 and generates the magnetic field to act with respect to the Hall IC 55 or 56. The switch lever 51 is movable in the front-rear direction as indicated by an arrow sign 59*a*. A forward movement indicates an ON state, whereas a backward movement indicates an OFF state. In a portion of the movable arm 52, a spring holding part 52*b* extending downward perpendicularly is formed. In addition, a spring 54 is disposed between the spring holding part 52*b* and an installation part 2*c* formed in the motor casing 2. Here, it is essential that the spring 54 is maintained so as not to be detached from a predetermined position. The movable arm 52 is connected to the motor casing 2 through the spring 54, so as to urge by moving the movable arm 52 toward the rear by the spring 54. An upper surface of the switch lever 51 forms a gripping surface 51*a*. On the gripping surface 51*a*, a plurality of grooves with fine separations are formed. The grooves are slightly tiled to form a crescent shape, and extend laterally. In the downward direction, a protruding part 51*b* is formed to be fit with a through hole 52*a* formed at a proximity of a front end of the movable arm 52. The protruding part 51*b* is arranged to extend from the outer side to the inner side of the motor casing 2 through a through hole 2*b* of the motor casing 2. The through hole 2*b* is in a predetermined size in the front-rear direction, thereby allowing the switch lever 51 to move in the direction indicated by the arrow sign 59*a*.

From a side perspective, the switch lever 51 substantially forms a T shape. Besides, the switch lever 51 is unable to be moved toward the front side if a rear end part is not pressed as indicated by an arrow sign 59*b*. To turn on the switch, the operator may press down a rear half of the switch lever 51 in a direction indicated by the arrow sign 59*b* while moving the switch lever 51 forward. A concave part 51*c* is formed on a lower surface on a front side of the switch lever 51. The concave part 51*c* is engaged with a convex part 2*d* formed at the motor casing 2, so that the switch lever 51 may remain in the ON state. Accordingly, an ON-lock function of the switch lever 51 is implemented. To turn off the switch, the rear end of the switch lever 51 is pressed downward as indicated by the arrow sign 59*b*, so as to cancel engagement of the convex part 2*d* and the concave part 51*c*. By using a restoring force of the spring 54, the switch lever 51 is restored to an original position (the position shown in FIG. 10), where the switch is in the OFF state.

At a proximity of the rear end of the movable arm 52, a holding part 52*c* is formed. The holding part 52*c* has a thickened thickness in the up-down direction to hold the magnet 53. A concave part is formed on a lower surface of the holding part 52*c*, and the magnet 53 is disposed in the concave part. The magnet 53 may be fixed to the movable arm 52 through adhesion, or through any other arbitrary fixing means, such as pressing. Together with the movement of the switch lever 51 in the front-rear direction, the movable arm 52 is linked and moved in the front-rear direction. Consequently, the magnet 53 is moved from a position on a rear side (the position shown in FIG. 10) to a position on a front side. At positions corresponding to the position on the rear side and the position on the front side, the Hall IC 55 and the Hall IC 56 are disposed. The Hall ICs 55 and 56 are disposed in the housing 61 to be separated from the upper wall 61*a* of the housing 61. Besides, the magnet 53 is located on an outer side of the control circuit side isolated area (see FIG. 4). However, it may also be configured such that a windshield plate provides coverage so a part where the magnet 53 works is not exposed to the cooling wind. Alternatively, it may also be configured such that the movable arm 52 is disposed in a third isolated space independent from the motor side isolated space and the control circuit side isolated area. In the following, the position of the magnet 53 with respects to the positions of the Hall ICs 55 and 56 is described with reference to FIG. 11(1) and FIG. 11(2).

Figure 11:
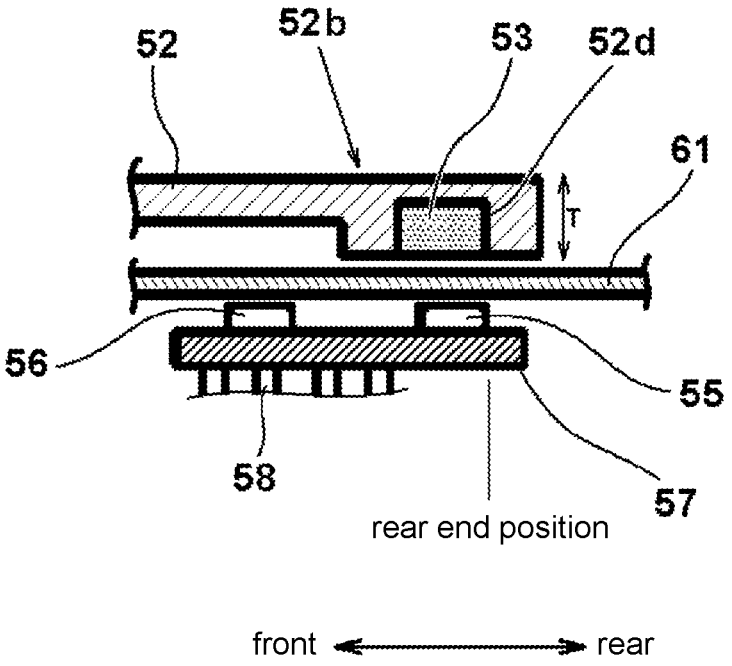
FIG. 11(1) and FIG. 11(2) are partial cross-sectional views illustrating positions of a magnet 53 of FIG. 10 with respect to positions of Hall ICs 55 and 56.
Figure 11:
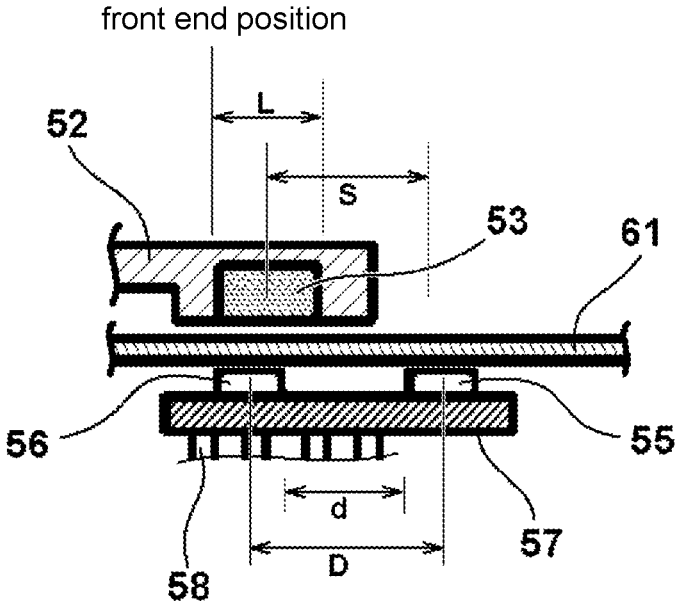

FIG. 11(1) and FIG. 11(2) are views illustrating the positions of the magnet 53 with respect to the positions of the Hall ICs 55 and 56. FIG. 11(1) illustrates a state where the switch is in the OFF state, and FIG. 11(2) illustrates a state where the switch is in the ON state. A wall thickness at a proximity of the rear end of the movable arm 52 is formed as a thickness T. On a lower surface side of the movable arm 52, a concave part 52*d* is formed. In the OFF state shown in FIG. 11(1), a rear end position of the magnet 53 is disposed to be consistent with a rear end position of the Hall IC 55. In the ON state shown in FIG. 11(2), a front end position of the magnet 53 is disposed to be consistent with a front end position of the Hall IC 56. Accordingly, a relation that a stroke S of the magnet is shorter than a distance between central positions of the Hall ICs 55 and 56 is formed. Besides, an interval d between the Hall ICs 55 and 56 is longer than a length L of the magnet 53. With such configuration, when the magnet 53 is at a position opposite to one of the Hall ICs, an influence of the other Hall IC on the magnetic field may be effectively eliminated, so as to provide a switch mechanism with fewer malfunctions.

In the following, a start control sequence using the motor 6 of the switch mechanism 50 of the embodiment is described with reference to FIG. 12. A flowchart shown in FIG. 12 may be implemented by having the microcomputer included in the computation part 71 perform a computer procedure, for example.

Figure 12:
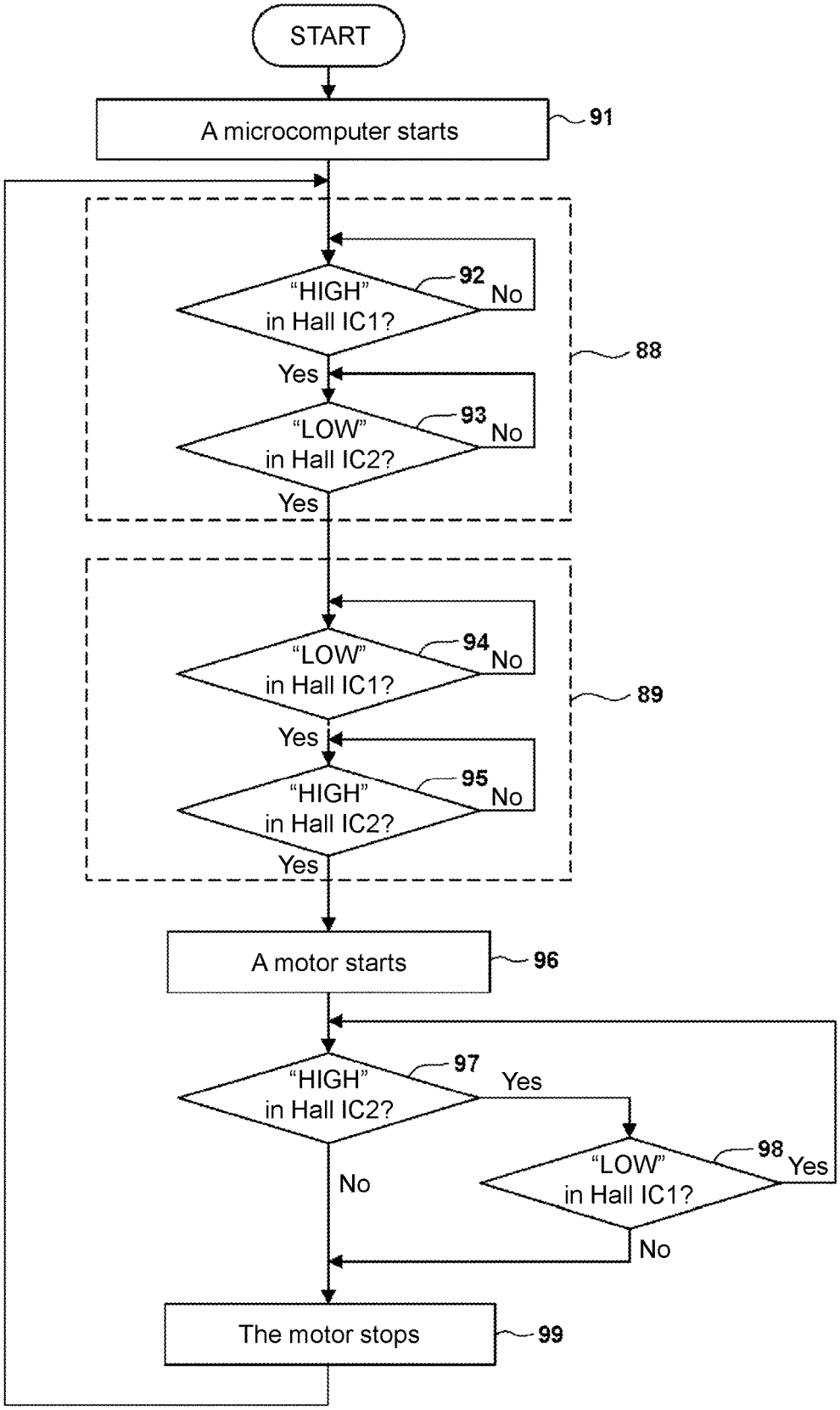
FIG. 12 is a flowchart illustrating a start control sequence of the motor 6 of the switch mechanism 50 of the embodiment.

In FIG. 12, if the power cord 28 of the electric tool 1 is connected to an AC socket not shown herein, power is supplied to the rectifier circuit 67, so as to supply power to a low voltage power circuit (not shown) as a power source of the control circuit connected to the rectifier circuit 67. Accordingly, the microcomputer included in the computation part 71 is started (Step 91).

Then, the microcomputer detects whether an output signal of the first Hall IC 55 is HIGH (Step 92). Here, the output of the first Hall IC 55 is HIGH when the magnet 53 approaches, and is LOW when the magnet 53 leaves away. For example, as shown in FIG. 1, when the switch lever 51 is in a position of the OFF state, since the magnet 53 is located at a near position opposite to the first Hall IC 55, the output of the first Hall IC is HIGH. At Step 92, when the output signal is HIGH, Step 93 is subsequently performed. However, when the output signal is maintained at LOW, namely when the switch lever 51 (see FIG. 3) is at a position of the ON state, a subsequent step is not performed following Step 92. This means that, if the switch lever 51 is not confirmed to be in the position of the OFF state, the motor 6 is not started. Therefore, by performing operation at Step 92, phenomena such as sudden rotation of the grindstone 29 caused by connecting the power cord 28 when the switch lever 51 is kept in the ON state can be certainly prevented.

Then, at Step 93, the microcomputer detects whether an output of the second Hall IC 56 is LOW. Here, like the output of the first Hall IC 55, the output of the second Hall IC 56 is HIGH when the magnet 53 approaches, and is LOW when the magnet 53 leaves away. Thus, at Step 93, when the output signal is LOW, Step 94 is subsequently performed. However, when the output signal is maintained at HIGH, namely when the switch lever 51 (see FIG. 3) is at the position of the ON state, a subsequent step is not performed following Step 93. Accordingly, at Steps 92 and 93, the microcomputer uses the first Hall IC 55 and the second Hall IC 56 to detect whether the switch lever 51 is in the OFF state (the position shown in FIG. 3). In an OFF state determining procedure 88, whether the switch lever 51 is in the OFF state is detected.

Then, detection on whether the switch lever 51 in the OFF state is switched to the ON state, namely an ON state determining procedure 89, is performed. First of all, the microcomputer determines whether the first Hall IC 55 is in the LOW state (Step 94). When the Hall IC 55 is in the HIGH state at the step, the process remains at Step 94 until the HIGH state becomes the LOW state. If the LOW state is detected at Step 94, the microcomputer then detects whether the second Hall IC 56 is in the HIGH state (Step 95). Thus, in the ON state determining procedure 89, the motor 6 is started (Step 96) when it is determined that detection values of the two Hall ICs are not contradictory and the detection values are correct.

If the motor 6 is started, the microcomputer detects whether the switch lever 51 is operated by monitoring the outputs of the first Hall IC 55 and the second Hall IC 56. First of all, the microcomputer determines whether the output of the second Hall IC 56 is HIGH (Step 97). The output of the second Hall IC 56 at HIGH here indicates that the magnet 53 is in the state of being right opposite to the second Hall IC 56 and the switch lever 51 is at the position of ON. Therefore, Step 98 is performed. At Step 98, the microcomputer detects whether the output of the first Hall IC 55 is LOW. The output of the first Hall IC 55 at LOW here indicates that the magnet 53 is not in the state of being right opposite to the first Hall IC 55. Accordingly, it is able to determine that the switch lever 51 is in the ON state by using the outputs of the two Hall ICs 55 and 56. The process thus returns to Step 97. Accordingly, when the switch lever 51 is in the ON state, the microcomputer monitors the output of the two Hall ICs 55 and 56 to determine whether the switch lever 51 is operated.

At Step 98, the output of the first Hall IC 55 at LOW indicates that the outputs of the first Hall IC 55 and the second Hall IC 56 are contradictory. Namely, anomalies may have occurred in the switch mechanism 50 or the computation part 71. Therefore, the rotation of the motor 6 is stopped after the process goes to Step 99 (an emergent stop due to anomaly detection of the switch mechanism 50). Alternatively, when it is determine that the output of the second Hall IC 56 is at LOW at Step 97, the process goes to Step 99 to stop the rotation of the motor 6 (a normal stop). Besides, when the process goes from Step 97 to Step 99 (in the case of No), an output state of the first Hall IC 55 is detected between the steps, so as to control by stopping the motor 6 after comparing whether the output values of the two Hall ICs are contradictory. Accordingly, in the case of stopping the motor 6, the motor 6 is immediately stopped based on an output result of only one Hall IC, thereby more rapidly stopping the motor 6. If the computation part 71 stops the rotation of the motor 6 at Step 99, the process returns to Step 92. In addition, regarding the process of the flowchart in FIG. 12, the process continues before the power supply to the microcomputer is turned off (e.g., the power supply from the power cord 28 is cut off, or the main switch is turned off in the case when a main switch is provided).

Accordingly, the switch mechanism 50 according to the embodiments is capable of switching electronically using the Hall ICs 55 and 56 having no mechanical contacts. Namely, the so-called electronic switch is adopted as a replacing means to increase the reliability of the switch mechanism 50. Also, the switch mechanism 50 may be miniaturized, and a manufacturing cost of the device may be reduced. Since the switch mechanism 50 does not have a switch contact, it does not easily malfunction. Besides, the Hall ICs (55 and 56) are disposed in the control circuit side isolated area, so the dust and moisture resistance can be improved. Moreover, the first Hall IC 55 for detecting the OFF state and the second Hall IC 56 for detecting the ON state are disposed, so as to use the outputs of the first and second Hall ICs 55 and 56 to control whether the motor 6 is turned on or off. Therefore, regardless of which of the Hall ICs malfunctions, the control may still be exerted by making the motor 6 stop or unable to be started, thereby providing an electric tool with further improved safety. Furthermore, before making the motor 6 rotate, the outputs of the plurality of Hall ICs are used to thoroughly detect whether the switch lever 51 is in the OFF state before performing the subsequent steps. Therefore, an operation such as a sudden start of the motor 6 at an instant when a plug of the power cord 28 is inserted into the socket of a commercial power source can be prevented.

Embodiment 2

Figure 13:
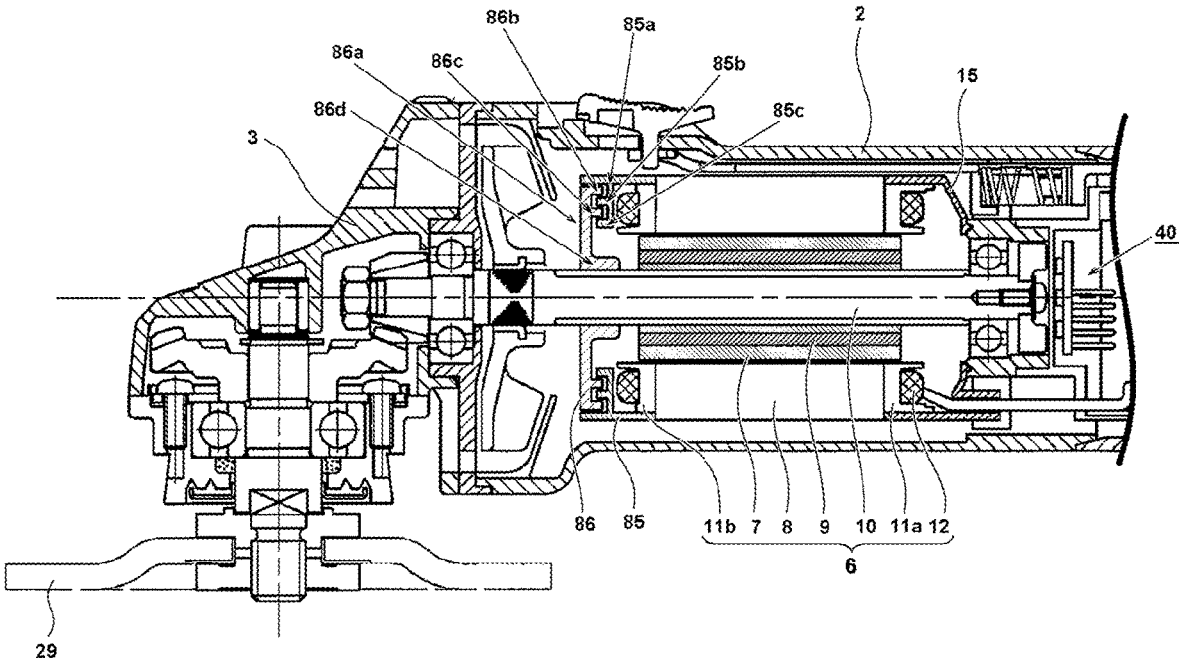
FIG. 13 is a partial cross-sectional view illustrating a structure of an electric tool having a labyrinth mechanism according to a second embodiment of the disclosure.

FIG. 13 is a partial cross-sectional view illustrating a structure of an electric tool having a labyrinth mechanism according to a second embodiment of the disclosure. In the second embodiment, the structure of the cover member on the front side of the motor 6 is changed, so as to further facilitate an effect of labyrinth. Here, a non-contact seal structure as follows is configured. Namely, the balance weight is not disposed. Instead, a windshield plate 86 and a cover member 85 are disposed as a balance member. In addition, a plurality of sections of concave and convex gaps are disposed between the windshield plate 86 and the cover member 85, so as to increase a channel resistance by extending a total length of the fine separation from outside to inside and substantially block an air flow from outside to inside. The windshield plate 86 is formed with an installation part 86*d*. The installation part 86*d* is formed in a cylindrical shape on a periphery of a through hole on an inner circumferential side. Also, a convex part continuous in the rotational direction, namely a cylindrical part 86*b*, and extending backward along the axial direction on an outer circumferential side of a disc part 86*a* is formed, and a cylindrical part 86*c* is similarly disposed on an inner side of the cylindrical part 86*b*. The cover member 85 is substantially in a cylindrical shape. An opening part on a rear side is pressed to the stator core 8 by using the outer circumferential side of the insulator 11*b*. On an inner circumferential side of the cover member 85, a ring part 85*a* protruding from the inner circumferential side is formed. Also, a cylindrical part 85*b* extending from a center of a radial direction of the ring part 85*a* toward the front side and a cylindrical part 85*c* extending from an innermost circumferential position in the radial direction of the ring part 85*a* toward the front side are formed. Here, the cylindrical parts 85*b* and 85*c* and the cylindrical parts 86*b* and 86*c* have respectively different shapes, and are arranged by being alternately positioned in the radial direction. Considering the ease of manufacture, it is preferred that the windshield plate 86 and the cover member 85 are formed integrally and made of synthetic resin or light metal.

Sealing properties on the front side of the motor 6 are significantly improved than those of the first embodiment, so dust, such as iron powder, that may have an undesirable influence on the operation can be prevented from being sucked into the motor 6, thereby lengthening the lifetime of the electric tool.

The disclosure is described above based on the foregoing embodiments. However, it should be understood that the disclosure is not limited to the foregoing embodiments, and various changes and modifications may be made without departing from the spirit of the disclosure. For example, in the embodiment, the circuit substrates 44 and 57 and the control substrate 65 are configured as independent substrates because independent substrates allow the magnetic fields generated by the magnets 14 and 52 as objects of detection to be properly detected. Therefore, as long as the Hall ICs are mounted in a way that enables high-precision magnetic field detection by the Hall ICs, all the Hall ICs 41 to 43 and 55 to 56 may also be mounted on a substrate same as the control substrate 65. Besides, in the embodiment, the example of the electric tool 1 is described by using a grinder as an example. However, the disclosure is not limited to grinder. Any type of electrical tools, such as a saber saw, a multi cutter, or the like, may be applicable as long as the electric tool has a cylindrical casing and the sensor magnet 14 is disposed to the rotation shaft of the motor 6. Moreover, the switch mechanism 50 is similarly applicable in any electric tool having a switch unit to turn on or off a motor.

What is claimed is:

1. An electric tool, comprising:

a motor having a stator and a rotor;

a rotation shaft integrally rotating with the rotor;

a casing accommodating the motor;

a ventilating window disposed in the casing;

a cooling fan sucking an air through the ventilating window to cool off the motor;

a magnetic body disposed to the rotation shaft;

a magnetic detection unit detecting a rotational position of the magnetic body; and a circuit substrate on which the magnetic detection unit is mounted;

wherein the circuit substrate and the magnetic body are disposed to be isolated from a wind path of a cooling wind generated by rotation of the cooling fan, wherein the magnetic detection unit comprises a plurality of sensors disposed on the circuit substrate.

2. The electric tool as claimed in claim 1, further comprising a control substrate on which a switch element is mounted, wherein the control substrate is disposed nearer to the ventilating window side than the circuit substrate.

3. The electric tool as claimed in claim 2, wherein the control substrate is disposed to be isolated from the wind path of the cooling wind.

4. The electric tool as claimed in claim 3, wherein the switch element is disposed on the control substrate, and at least a portion of the switch element is located within the wind path of the cooling wind.

5. The electric tool as claimed in claim 4, further comprising a bearing holding part holding a bearing of the motor and at least covering an outer side of a radial direction of the magnetic body, wherein after cooling off the switch element, the cooling wind passes around an outer circumferential side of the bearing holding part to cool off the motor.

6. The electric tool as claimed in claim 2, wherein the control substrate is configured to extend in an axial direction of the rotation shaft.

7. The electric tool as claimed in claim 2, wherein a rectifier circuit is disposed on the control substrate, and at least a portion of the rectifier circuit is located within the wind path of the cooling wind and nearer to the ventilating window side than the switch element.

8. The electric tool as claimed in claim 1, wherein the motor comprises a brushless motor.

9. An electric tool, comprising:

a casing having a motor casing that is integrally formed in a substantially cylindrical shape;

a motor accommodated in the motor casing and having a rotation shaft;

a ventilating window and an outlet disposed on the casing;

a cooling fan sucking an air through the ventilating window and generates a cooling wind to cool off the motor;

a switch element controlling a power supply to the motor;

a control substrate on which the switch element is mounted;

a bearing axially supporting the rotation shaft and located between the motor the control substrate in a direction extending long an axial direction of the rotation shaft;

a magnetic body integrally rotating with the rotation shaft; and a magnetic detection unit detecting a rotational position of the magnetic body;

wherein the magnetic body and the magnetic detection unit are disposed between the control substrate and the bearing in the axial direction, the magnetic body and the magnetic detection unit are disposed to be isolated from a wind path of the cooling wind cooling off the motor after cooling off the switch element, and the electric tool further comprises:

a circuit substrate on which the magnetic detection unit is mounted, wherein the circuit substrate is configured to extend in a direction orthogonal to the axial direction of the rotation shaft.

10. The electric tool as claimed in claim 9, wherein the control substrate is disposed nearer to the ventilating window side than the circuit substrate.

11. The electric tool as claimed in claim 10, wherein the control substrate is disposed to be isolated from the wind path of the cooling wind generated by rotation of the cooling fan.

12. An electric tool, comprising:

a motor having a stator and a rotor;

a rotation shaft integrally rotating with the rotor;

a casing accommodating the motor;

a ventilating window disposed in the casing;

a cooling fan sucking an air through the ventilating window to cool off the motor;

a magnetic body disposed to the rotation shaft;

a magnetic detection unit detecting a rotational position of the magnetic body; and a circuit substrate on which the magnetic detection unit is mounted;

wherein the circuit substrate and the magnetic body are disposed to be isolated from a wind path of a cooling wind generated by rotation of the cooling fan, wherein the circuit substrate is configured to extend in a direction orthogonal to an axial direction of the rotation shaft.

13. The electric tool as claimed in claim 12, further comprising a control substrate on which a switch element is mounted, wherein the control substrate is disposed nearer to the ventilating window side than the circuit substrate.

14. The electric tool as claimed in claim 13, wherein the control substrate is disposed to be isolated from the wind path of the cooling wind.

15. The electric tool as claimed in claim 14, wherein the switch element is disposed on the control substrate, and at least a portion of the switch element is located within the wind path of the cooling wind.

16. The electric tool as claimed in claim 15, further comprising a bearing holding part holding a bearing of the motor and at least covering an outer side of a radial direction of the magnetic body, wherein after cooling off the switch element, the cooling wind passes around an outer circumferential side of the bearing holding part to cool off the motor.

17. The electric tool as claimed in claim 13, wherein the control substrate is configured to extend in the axial direction of the rotation shaft.

18. The electric tool as claimed in claim 13, wherein a rectifier circuit is disposed on the control substrate, and at least a portion of the rectifier circuit is located within the wind path of the cooling wind and nearer to the ventilating window side than the switch element.

19. The electric tool as claimed in claim 12, wherein the magnetic detection unit comprises a plurality of sensors disposed on the circuit substrate.

20. The electric tool as claimed in claim 12, wherein the motor comprises a brushless motor.

* * * * *